US011676537B2

(12) United States Patent
Zhang et al.

(10) Patent No.: US 11,676,537 B2
(45) Date of Patent: Jun. 13, 2023

(54) PIXEL DRIVING CIRCUIT, DISPLAY PANEL AND DISPLAY APPARATUS

(71) Applicants: WUHAN TIANMA MICROELECTRONICS CO., LTD., Wuhan (CN); Wuhan Tianma Microelectronics Co., Ltd. Shanghai Branch, Shanghai (CN)

(72) Inventors: Mengmeng Zhang, Wuhan (CN); Xingyao Zhou, Wuhan (CN); Yue Li, Wuhan (CN); Jian Kuang, Wuhan (CN); Yuantao Wu, Shanghai (CN)

(73) Assignees: WUHAN TIANMA MICROELECTRONICS CO., LTD., Wuhan (CN); Wuhan Tianma Microelectronics Co., Ltd. Shanghai Branch, Shanghai (CN)

( * ) Notice: Subject to any disclaimer, the term of this patent is extended or adjusted under 35 U.S.C. 154(b) by 0 days.

(21) Appl. No.: 17/837,996

(22) Filed: Jun. 10, 2022

(65) Prior Publication Data

US 2022/0328003 A1 Oct. 13, 2022

(30) Foreign Application Priority Data

Dec. 9, 2021 (CN) ..... 202111498291.8

(51) Int. Cl.
*G09G 3/3233* (2016.01)

(52) U.S. Cl.
CPC ..... *G09G 3/3233* (2013.01); *G09G 2300/043* (2013.01); *G09G 2300/0819* (2013.01);
(Continued)

(58) Field of Classification Search
None
See application file for complete search history.

(56) References Cited

U.S. PATENT DOCUMENTS

2003/0222589 A1* 12/2003 Osame ..... H01L 33/08 315/169.1
2014/0117862 A1* 5/2014 Qing ..... G09G 3/3233 315/172

(Continued)

FOREIGN PATENT DOCUMENTS

CN 103728803 A 5/2014
CN 112670305 A 4/2021

*Primary Examiner* — Dorothy Harris
(74) *Attorney, Agent, or Firm* — Christensen O'Connor Johnson Kindness PLLC

(57) ABSTRACT

Provided is a pixel driving circuit, a display panel and a display apparatus. The pixel driving circuit includes: driving transistor having gate electrode connected to first node, first electrode connected to second node, and second electrode electrically connected to third node coupled to light emitting element; storage capacitor connected to the first node; and M first transistors having M first and second electrodes connected to the first node M functional signal terminals, respectively, M≥1. A driving cycle of the pixel driving circuit includes light-emitting stage and N non-light-emitting stages, N≥M. The M first transistors are respectively turned on in the N non-light-emitting stages, and the M first transistors are all turned off in the light-emitting stage. One of the N non-light-emitting stages includes first non-light-emitting stage adjacent to the light-emitting stage. Channel length L and width W of the first transistor satisfy:

$$W \times L < \frac{C_{st} \times \Delta V}{\sum_{i=1}^{i=M} \frac{C_{ox} \times (V_{G_off} - V_{N1})^2}{|V_{G_off} - V_{N1}| + |V_{G_off} - V_{X_i}|}}.$$

17 Claims, 13 Drawing Sheets

(52) U.S. Cl.
CPC ..... *G09G 2300/0842* (2013.01); *G09G 2310/0251* (2013.01); *G09G 2310/08* (2013.01); *G09G 2320/02* (2013.01)

(56) References Cited

U.S. PATENT DOCUMENTS

| | | | | |
|---|---|---|---|---|
| 2020/0243151 | A1* | 7/2020 | Li | G09G 3/2092 |
| 2021/0097936 | A1* | 4/2021 | Ge | G09G 3/2011 |
| 2021/0335260 | A1* | 10/2021 | Wang | G09G 3/3258 |
| 2022/0208797 | A1* | 6/2022 | Lai | G09G 3/3241 |

* cited by examiner

PIXEL DRIVING CIRCUIT, DISPLAY PANEL AND DISPLAY APPARATUS

CROSS-REFERENCE TO RELATED APPLICATION

The present application claims priority to Chinese Patent Application No. 202111498291.8, filed on Dec. 9, 2021, the content of which is incorporated herein by reference in its entirety.

TECHNICAL FIELD

The present disclosure relates to the field of display technologies and, particularly, relates to a pixel driving circuit, a display panel, and a display apparatus.

BACKGROUND

Organic light emitting diode (OLED) display panels have gradually become a mainstream for display screens such as mobile phones, TVs, and computers due to their self-luminous, fast response, wide color gamut, large viewing angle, and high brightness.

OLED is a current-driven device, when the OLED emits light, a driving transistor of a pixel driving circuit is required to be controlled to provide a driving current to the OLED device, thereby causing it to emit light. In the pixel driving circuit, since a gate voltage of the driving transistor is unstable, the optical performance of the OLED controlled by the driving transistor may be adversely affected.

SUMMARY

In view of this, the present disclosure provides a pixel driving circuit, a display panel, and a display apparatus to improve the optical effect of OLEDs.

A first aspect of the present disclosure provides a pixel driving circuit, including: a driving transistor having a gate electrode electrically connected to a first node, a first electrode electrically connected to a second node, and a second electrode electrically connected to a third node, the third node being coupled to a light emitting element; a storage capacitor connected to the first node; and M first transistors having first electrodes connected to the first node and second electrodes electrically connected to M functional signal terminals, M being an integer greater than or equal to 1. A driving cycle of the pixel driving circuit includes a light-emitting stage and N non-light-emitting stages, and N is an integer greater than or equal to M. The M first transistors are respectively turned on in the N non-light-emitting stages, and the M first transistors are all turned off in the light-emitting stage. One of the N non-light-emitting stages includes a first non-light-emitting stage adjacent to the light-emitting stage. A channel length L and a width W of each of the M first transistors satisfy:

$$W \times L < \frac{C_{st} \times \Delta V}{\sum_{i=1}^{i=M} \frac{C_{ox} \times (V_{G_off} - V_{N1})^2}{|V_{G_off} - V_{N1}| + |V_{G_off} - V_{X_i}|}}.$$

In the above formula, $C_{st}$ is a capacitance value of the storage capacitor; $\Delta V$ is a critical variation of a potential of the first node when a preset condition is met; $V_{G_off}$ is a potential applied to the gate electrode of the first transistor when the first transistor is turned off; $V_{N1}$ is an initial potential of the first node when the light emitting element emits light; $C_{ox}$ is a capacitance per unit area of a gate capacitor including the gate electrode of the first transistor, a gate insulating layer and a channel: $V_{X_i}$ is a potential of an $i^{th}$ functional signal terminal X_i in the first non-light-emitting stage.

Based on the same inventive concept, a second aspect of the present disclosure provides a display panel including at least one pixel driving circuit, and the at least one driving circuit includes: a driving transistor having a gate electrode electrically connected to a first node, a first electrode electrically connected to a second node, and a second electrode electrically connected to a third node, the third node being coupled to a light emitting element; a storage capacitor connected to the first node; and M first transistors having first electrodes connected to the first node and second electrodes electrically connected to M functional signal terminals, M being an integer greater than or equal to 1. A driving cycle of the pixel driving circuit includes a light-emitting stage and N non-light-emitting stages, and N is an integer greater than or equal to M. The M first transistors are respectively turned on in the N non-light-emitting stages, and the M first transistors are all turned off in the light-emitting stage. One of the N non-light-emitting stages includes a first non-light-emitting stage adjacent to the light-emitting stage. A channel length L and a width W of each of the M first transistors satisfy:

$$W \times L < \frac{C_{st} \times \Delta V}{\sum_{i=1}^{i=M} \frac{C_{ox} \times (V_{G_off} - V_{N1})^2}{|V_{G_off} - V_{N1}| + |V_{G_off} - V_{X_i}|}}.$$

value of the storage capacitor; $\Delta V$ is a critical variation of a potential of the first node when a preset condition is met; $V_{G_off}$ is a potential applied to the gate electrode of the first transistor when the first transistor is turned off; $V_{N1}$ is an initial potential of the first node when the light emitting element emits light: $C_{ox}$ is a capacitance per unit area of a gate capacitor including the gate electrode of the first transistor, a gate insulating layer and a channel: $V_{X_i}$ is a potential of an $i^{th}$ functional signal terminal X_i in the first non-light-emitting stage.

Based on the same inventive concept, a third aspect of the present disclosure provides a display apparatus including a display panel, the display panel includes at least one pixel driving circuit, and the at least one driving circuit includes: a driving transistor having a gate electrode electrically connected to a first node, a first electrode electrically connected to a second node, and a second electrode electrically connected to a third node, the third node being coupled to a light emitting element; a storage capacitor connected to the first node; and M first transistors having first electrodes connected to the first node and second electrodes electrically connected to M functional signal terminals, M being an integer greater than or equal to 1. A driving cycle of the pixel driving circuit includes a light-emitting stage and N non-light-emitting stages, and N is an integer greater than or equal to M. The M first transistors are respectively turned on in the N non-light-emitting stages, and the M first transistors are all turned off in the light-emitting stage. One of the N non-light-emitting stages includes a first non-light-emitting stage adjacent to the light-emitting stage. A channel length L and a width W of each of the M first transistors satisfy:

$$W \times L < \frac{C_{st} \times \Delta V}{\sum_{i=1}^{i=M} \frac{C_{ox} \times (V_{G_off} - V_{N1})^2}{|V_{G_off} - V_{N1}| + |V_{G_off} - V_{X_i}|}}.$$

In the above formula, $C_{st}$ is a capacitance value of the storage capacitor: ΔV is a critical variation of a potential of the first node when a preset condition is met; $V_{G}$_off is a potential applied to the gate electrode of the first transistor when the first transistor is turned off; $V_{N1}$ is an initial potential of the first node when the light emitting element emits light; $C_{ox}$ is a capacitance per unit area of a gate capacitor including the gate electrode of the first transistor, a gate insulating layer and a channel: $V_{X_i}$ is a potential of an $i^{th}$ functional signal terminal X_i in the first non-light-emitting stage.

BRIEF DESCRIPTION OF DRAWINGS

In order to better illustrate technical solutions of embodiments of the present disclosure, the accompanying drawings used in the embodiments are described below. The drawings described below are merely a part of the embodiments of the present disclosure. Based on these drawings, those skilled in the art can obtain other drawings.

DESCRIPTION OF EMBODIMENTS

Figure 1:
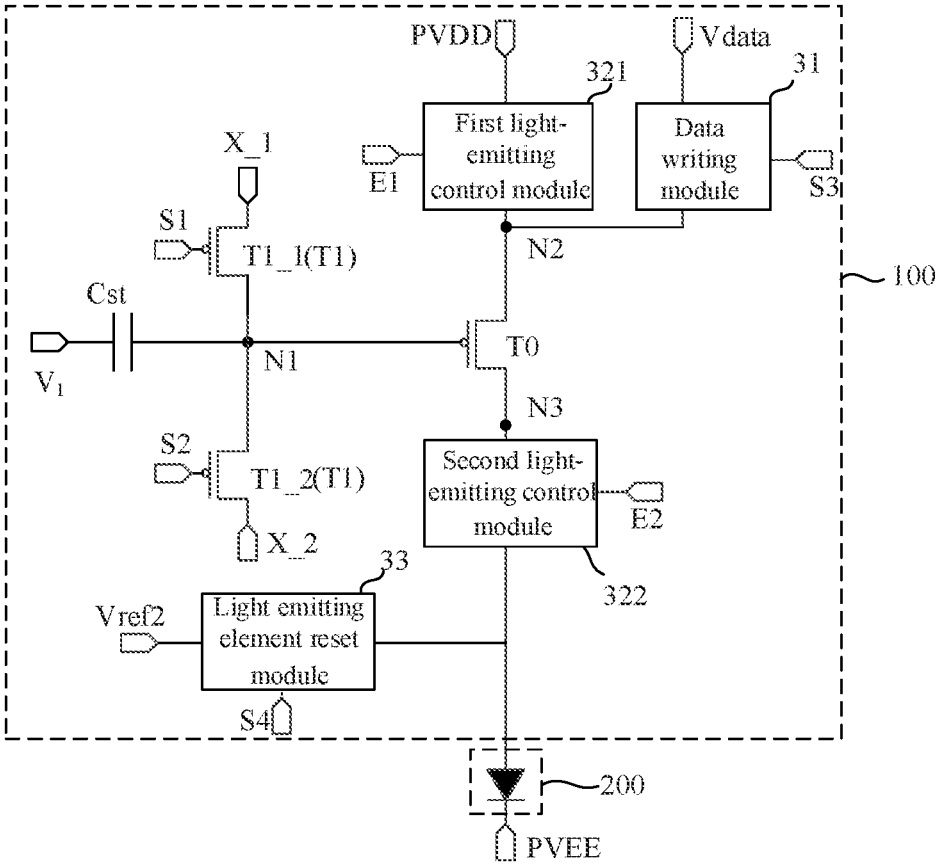
FIG. 1 is a schematic diagram of a pixel driving circuit according to an embodiment of the present disclosure.

In order to better understand technical solutions of the present disclosure, embodiments of the present disclosure are described in details with reference to the drawings.

It should be clear that the described embodiments are merely part of the embodiments of the present disclosure rather than all of the embodiments. It is appreciated that, those skilled in the art can make various modifications and changes without departing from the spirit or scope of the present disclosure. Therefore, the present disclosure intends to cover the modifications and changes of the present disclosure that fall within the scope of the corresponding claims (claimed technical solutions) and their equivalents.

It should be noted that the implementation manners provided by the embodiments of the present disclosure can be combined with each other if there is no contradiction.

The terms used in the embodiments of the present disclosure are merely for the purpose of describing specific embodiment, rather than limiting the present disclosure. The terms "a". "an", "the" and "said" in a singular form in an embodiment of the present disclosure and the attached claims are also intended to include plural forms thereof, unless noted otherwise.

It should be understood that the term "and/or" used in the context of the present disclosure is to describe a correlation relation of related objects, indicating that there may be three relations, e.g., A and/or B may indicate only A, both A and B. and only B. In addition, the symbol "/" in the context generally indicates that the relation between the objects in front and at the back of "/" is an "or" relationship.

It should be understood that although the terms 'first' and 'second' may be used in the present disclosure to describe transistors, these transistors should not be limited to these terms. These terms are used only to distinguish the transistors from each other. For example, without departing from the scope of the embodiments of the present disclosure, a first transistor may also be referred to as a second transistor. Similarly, the second transistor may also be referred to as the first transistor.

The transistors used in all embodiments of the present disclosure can be thin film transistors, field effect transistors or other devices with the same characteristics. In the embodiments of the present disclosure, in order to distinguish two electrodes of the transistor except a gate electrode, one of the two electrodes is called a first electrode, and the other of the two electrodes is called a second electrode. In actual operations, the first electrode may be a drain electrode, and the second electrode may be a source electrode. Alternatively, the first electrode may be a source electrode, and the second electrode may be a drain electrode.

In the embodiments of the present disclosure, the term "coupled" means that two or more components have direct physical or electrical contact, and two or more components are not in direct contact with each other, but still cooperate or interact with each other.

An embodiment of the present disclosure provides a pixel driving circuit electrically connected to a light emitting element. As shown in FIG. 1, FIG. 1 is a schematic diagram of a pixel driving circuit according to an embodiment of the present disclosure. The pixel driving circuit 100 includes a driving transistor T0, a storage capacitor $C_{st}$, and M first transistors T1. In the embodiments of the present disclosure, M is an integer greater than or equal to 1.

A gate electrode of the driving transistor T0 is electrically connected to a first node N1, a first electrode of the driving transistor T0 is electrically connected to a second node N2. A second electrode of the driving transistor T0 is electrically connected to a third node N3, and the third node N3 is coupled to the light emitting element 200. In embodiments of the present disclosure, by adjusting potential of the first node N1, the magnitude of the current flowing to a light emitting element 200 can be adjusted.

A first electrode plate of the storage capacitor $Cs_t$ is electrically connected to the first node N1. In embodiments of the present disclosure, according to different functions to be implemented by the pixel driving circuit 100, a duty cycle of the pixel driving circuit may include a light-emitting stage and N non-light-emitting stages, where N may be a positive integer greater than or equal to M. For example, at least one non-light-emitting stage includes a data writing stage. In the data writing stage, a voltage signal related to a data voltage can be written into the first node N1 so as to charge the first node N1. In the light-emitting stage after charging of the first node N1 is completed, the storage capacitor $C_{st}$ can maintain the potential of the first node N1, so that the driving transistor T0 can be turned on smoothly, and the light emitting element 200 is driven to emit light.

In embodiments of the present disclosure, the above first transistor T1 refers to a transistor whose first electrode is connected to the first node N1. The first electrode may be a source electrode, and the second electrode may be a drain electrode. Alternatively, the first electrode may be a drain electrode, and the second electrode is a source electrode, which are not limited in the present disclosure. The second electrodes of the M first transistors T1 can be electrically connected to the M functional signal terminals, respectively. In embodiments of the present disclosure, channel types and channel parameters of the M first transistors can all be the same.

In order to describe the embodiments of the present disclosure more clearly, the M first transistors T1 are respectively named as a first first transistor T1_1, a second first transistor T1_2, . . . , an $(i-1)^{th}$ first transistor T1_(i−1), an $i^{th}$ first transistor T1_*i*, an $(i+1)^{th}$ first transistor T1_(i+1), . . . , and an $M^{th}$ first transistor T1_M. M functional signal terminals electrically connected to the second electrodes of the M first transistors are respectively named as a first functional signal terminal X_1, a second functional signal terminal X_2, . . . , an $(i-1)^{th}$ functional signal terminal X_(i-1), an $i^{th}$ functional signal terminal X_i, an $(i+1)^{th}$ functional signal terminal X_(i+1), . . . , and an $M^{th}$ functional signal terminal X_M. A second electrode of the $i^{th}$ first transistor T1_*i* is electrically connected to the $i^{th}$ functional signal terminal X_i. In FIG. 1, M=2 is set, that is, the pixel driving circuit 100 includes a first first transistor T1_1 and a second first transistor T1_2, in which the first first transistor T1_1 is electrically connected to the first functional signal terminal X_I, and the second first transistor T1_2 is electrically connected to the second functional signal terminal X_2.

It should be noted that, w % ben multiple first transistors T1 are provided in the pixel driving circuit, the second electrodes of different first transistors T1 can be connected to a same functional signal terminal X, or to different functional signal terminals X, which are not limited thereto in the embodiments of the present disclosure. The above expressions of the $i^{th}$ first transistor T1_*i* and the $i^{th}$ functional signal terminal X_i are only used to distinguish the first transistors T1 with different connection manners of the second electrodes. In embodiments of the present disclosure, channel types and channel parameters of the M first transistors may all be the same. Therefore, when the second electrode of the $i^{th}$ first transistor T1_*i* has the same connection manner as the second electrode of the $j^{th}$ first transistor T1_*j*, the labels of the $i^{th}$ first transistor T1_*i* and the $j^{th}$ first transistor T1_*j* can be interchanged. That is, the $i^{th}$ first transistor T1_*i* may also be referred to as the j*first transistor T1_*j*. Among them, i and j are positive integers less than or equal to M. and i≠j.

In some embodiments of the present disclosure, the above functional signal terminal X may directly be electrically connected to a functional signal line that provides a corresponding functional signal.

Alternatively, in embodiments of the present disclosure, the above functional signal terminal X may be electrically connected to the corresponding functional signal line through an electrical element including a transistor. For example, in embodiments of the present disclosure, P second transistors T2 may be provided in the pixel driving circuit 100, and P is a positive integer greater than or equal to 1. At least P functional signal terminals X of the M functional signal terminals X are one-to-one electrically connect to the first electrodes of the P second transistors T2. That is, the second electrodes of at least P functional signal terminals X are electrically connect to the first electrodes of P second transistors T2. Alternatively, in some embodiments of the present disclosure, at least one of the above M functional signal terminals X may be electrically connected to the first electrodes of P second transistors T2. That is, the second electrode of at least one first transistor T1 is electrically connected to the first electrodes of P second transistors T2. In embodiments of the present disclosure, the second electrodes of the second transistors T2 can be directly electrically connected to the corresponding functional signal lines, or the second electrodes of the second transistor T2 can also be electrically connected to the corresponding functional signal lines through other transistors.

Figure 2:
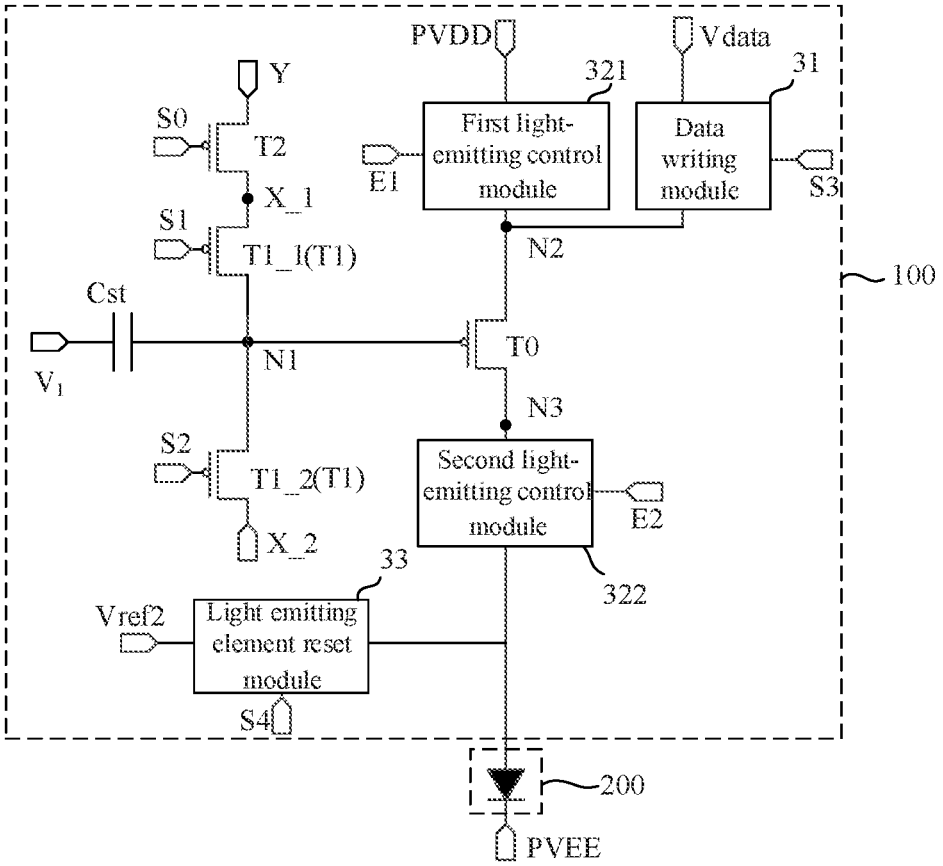
FIG. 2 is another schematic diagram of a pixel driving circuit according to an embodiment of the present disclosure.

As shown in FIG. 2, FIG. 2 is another schematic diagram of a pixel driving circuit according to an embodiment of the present disclosure. For example, M=2 and P=1. The first functional signal terminal X_1 is electrically connected to the first electrode of the second transistor T2. The second electrode of the second transistor T2 is electrically connected to a functional signal line Y. The second functional signal terminal X_2 electrically connected to a second first transistor T1_2 is directly electrically connected to the corresponding functional signal line.

Figure 3:
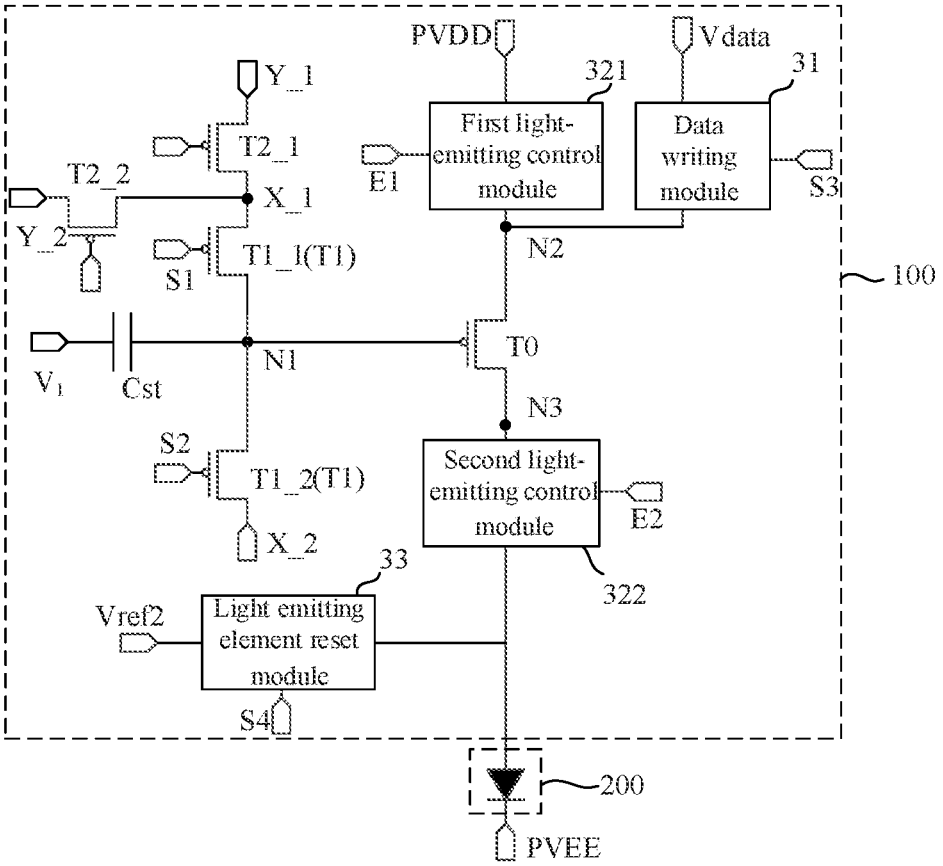
FIG. 3 is another schematic diagram of a pixel driving circuit according to an embodiment of the present disclosure.

As shown in FIG. 3, FIG. 3 is another schematic diagram of a pixel driving circuit according to an embodiment of the present disclosure. For example, M=2, and P=2. The first functional signal terminal X_1 is electrically connected to the first electrode of the first second transistor T2_1 and the first electrode of the second second transistor T2_2, respectively. The second electrode of the first second transistor T2_1 is electrically connected to the functional signal line Y_1. The second electrode of the second second transistor T2_2 is electrically connected to the function signal line Y_2.

Figure 4:
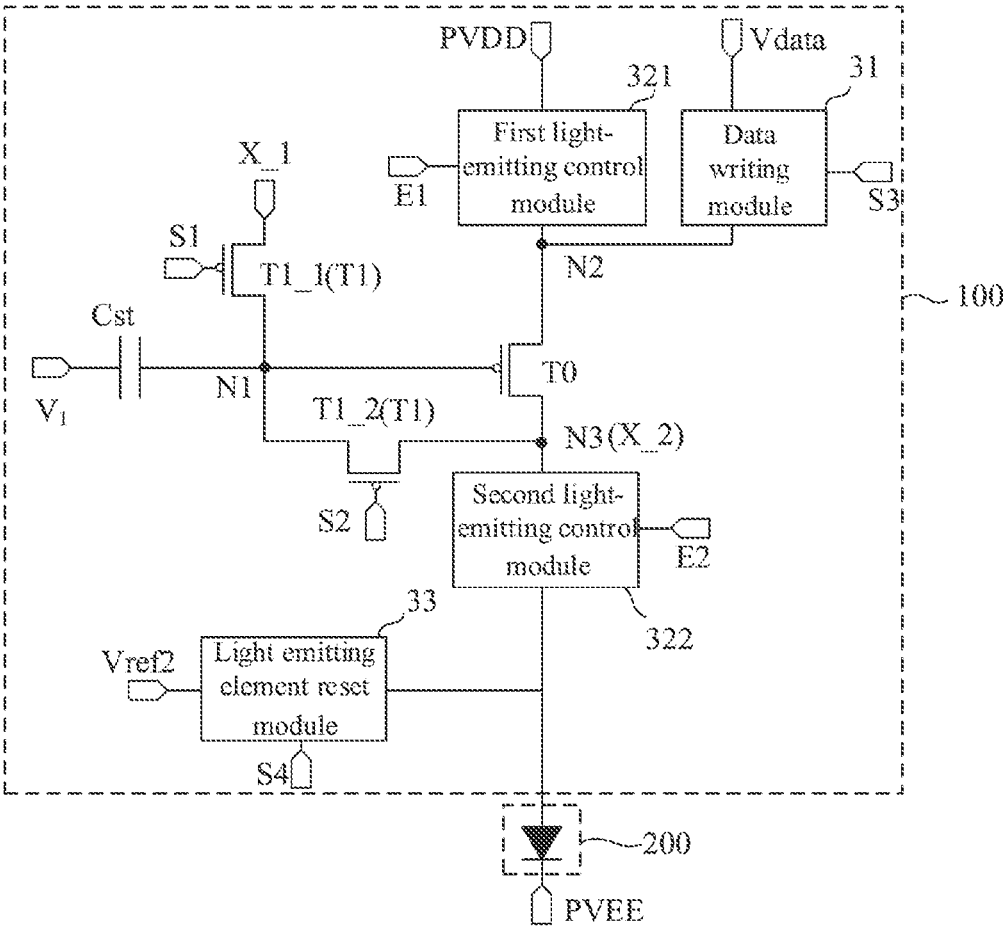
FIG. 4 is another schematic diagram of a pixel driving circuit according to an embodiment of the present disclosure.

In some embodiments, the above functional signal terminal X may also be a node that includes a certain required signal in the pixel driving circuit 100. As shown in FIG. 4, FIG. 4 is another schematic diagram of a pixel driving circuit according to an embodiment of the present disclosure. For example, M=2. A second electrode of a first first transistor T1_1 is electrically connected to a first functional signal terminal X_1. A second electrode of a second first transistor T1_2 is electrically connected to a third node N3. That is, the third node N3 serves as a second functional signal terminal X_2. When the second first transistor T1_2 is turned on, signals of the third node N3 can be written into the first node N1 through the second first transistor T1_2.

As mentioned above, in embodiments of the present disclosure, a driving cycle of the pixel driving circuit 100 may include a light-emitting stage and N non-light-emitting stages. The non-light-emitting stage may be located before the light-emitting stage. During operation of the pixel driving circuit, the M first transistors T1 can be turned on in a time-division manner in the N non-light-emitting stages, so as to utilize the M functional signals electrically connected to the M first transistors T1 to adjust the potential of the first node N1. In the light-emitting stage, the M first transistors T1 are turned off to light up the light emitting element 200.

For example, two first transistors T1 are provided in the pixel driving circuit 100, and the second electrodes of the two first transistors T1 are electrically connected to two functional signal terminals X, respectively. In embodiments of the present disclosure, one of the functional signal terminals X receives a first reset signal, and the other of the function signal terminals X receives a threshold compensation signal. The threshold compensation signal refers to a signal related to a threshold voltage of the driving transistor T0. At least two non-light-emitting stages can be set in the driving cycle of the pixel driving circuit 100. These two non-light-emitting stages can be a first node reset stage and a threshold compensation stage, respectively. In the first node reset stage, in embodiments of the present disclosure, the second electrode of one of the first transistors T1 receives a first reset signal to reset a first node N1. In the threshold compensation stage, the second electrode of the other of first transistors T1 receives a threshold compensation signal to compensate a threshold voltage of the driving transistor T0.

In some embodiments, the functional signal provided by the aforementioned functional signal terminal may be a constant signal, or may be a non-constant signal that changes with the change of the working stage of the pixel driving circuit. For example, when the second electrode of the first transistor T1 receives a non-constant signal through the functional signal terminal X, in order to enable the pixel driving circuit to reset the first node N1 and compensate the threshold of the driving transistor T0, embodiments of the present disclosure can provide only one first transistor T1 in the pixel driving circuit 100. Similarly, at least two non-light-emitting stages are provided in the driving cycle of the pixel driving circuit 100. These two non-light-emitting stages are a first node reset stage and a threshold compensation stage. In the first node reset stage, the first reset signal can be received by the second electrode of the first transistor T1 to reset the first node N1. In the threshold compensation stage, the second electrode of the first transistor T1 can receive a threshold compensation signal to compensate a threshold voltage of the driving transistor T0. That is to say, the functional signal terminal X connected to the second electrode of the first transistor T1 provides the first reset signal in the first node reset stage, and provides the threshold compensation signal in the threshold compensation stage.

In embodiments of the present disclosure, a channel length L and a width W of the first transistor T1 satisfy:

$$W \times L < \frac{C_{st} \times \Delta V}{\sum_{i=1}^{i=M} \frac{C_{ox} \times (V_{G_off} - V_{N1})^2}{|V_{G_off} - V_{N1}| + |V_{G_off} - V_{X_i}|}}, \quad (1)$$

where $C_{st}$ is a capacitance value of the storage capacitor $C_{st}$, and ($C_{ox}$ is a capacitance per unit area of a gate capacitor.

Figure 5:
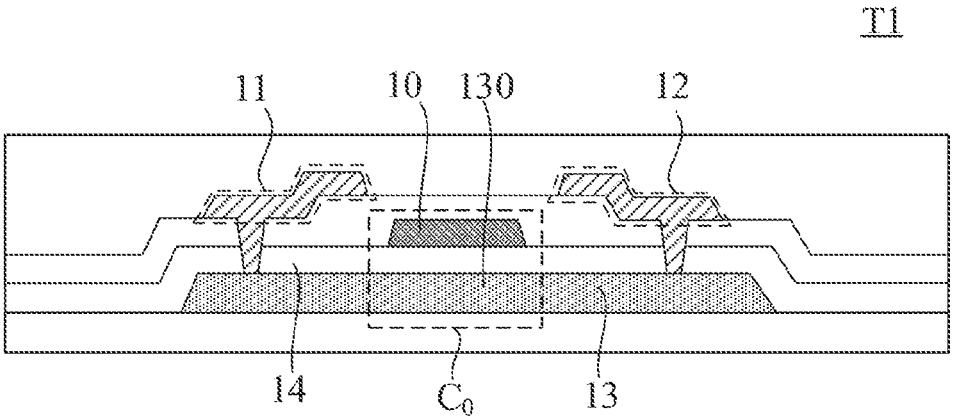
FIG. 5 is a cross-sectional view of a first transistor according to an embodiment of the present disclosure.

As shown in FIG. 5, FIG. 5 is a cross-sectional view of a first transistor according to an embodiment of the present disclosure. The first transistor T1 includes a gate electrode 10, a first electrode 11, a second electrode 12, and an active layer 13. The active layer 13 includes a channel 130. In different stages of the pixel driving circuit, signals for controlling the turn-on or turn-off of the first transistor T1 is applied to the gate electrode 10 of the first transistor T1. When a control signal is applied to the gate electrode 10 of the first transistor T1 to turn on the channel 130, the corresponding signal can be transmitted between the first electrode 11 and the second electrode 12.

As shown in FIG. 5, a gate insulating layer 14 is included between the gate electrode 10 and the active layer 13. A gate capacitor $C_0$ is formed in the first transistor T1. The gate capacitor $C_0$ includes the gate electrode 10, the gate insulating layer 14 and the channel 130 of the first transistor T1. The gate electrode 10 and the channel 130 correspond to two electrode plates of the gate capacitor $C_0$, and the gate insulating layer 14 corresponds to the dielectric medium in the gate capacitor $C_0$. The capacitance value $C_0$ of the gate capacitor C0 satisfies:

$$C_0 = C_{ox} \times W \times L \quad (2),$$

where W is a width of the channel 130, and L is a length of the channel 130. The value of $C_{ox}$ can be obtained after the materials and the thickness of the gate insulating layer 14 are determined.

Further to the above formula (1), $V_{G_off}$ is a potential applied to the gate electrode 10 of the first transistor T1 when the first transistor T1 is turned off.

$V_{N1}$ is an initial potential of the first node N1 when the light emitting element 200 emits light. As mentioned above, the driving cycle of the pixel driving circuit 100 may include a light-emitting stage and N non-light-emitting stages. The expression "the initial potential of the first node N1 when the light emitting element 200 emits light" refers to the potential of the first node N1 when the pixel driving circuit 100 just enters the light-emitting stage during a driving cycle, such as in display time of one image frame. In other words, the expression "the initial potential of the first node N1 when the light emitting element 200 emits light" may refer to the potential of the first node N1 at the instant when a light-emitting current reaches the light emitting element 200 during the display time of one image frame.

$V_{X_i}$ is a potential of an $i^{th}$ functional signal terminal X_i in the first non-light-emitting stage. The first non-light-emitting stage refers to a non-light-emitting stage adjacent to the light-emitting stage among the above N non-light-emitting stages. The expression "the first non-light-emitting stage is adjacent to the light-emitting stage" may refer to no other non-light-emitting stages are included between the first non-light-emitting stage and the light-emitting stage. In this context, "adjacent" refers to temporally adjacent. In embodiments of the present disclosure, the signal of the $i^{th}$ functional signal terminal X_i may be constant. Alternatively, the signal of the $i^{th}$ functional signal terminal X_i may also change with the change of the working stage of the pixel driving circuit. In the case where the signal of the $i^{th}$ functional signal terminal X_i changes with the change of the working stage of the pixel driving circuit, in the above formula (1), $V_{X_i}$ a potential of the $i^{th}$ functional signal terminal X_i in the first non-light-emitting stage.

It should be noted that, as shown in FIG. 2 and FIG. 3, the $i^{th}$ functional signal terminal X_i receives the corresponding functional signal through the second transistor T2, if the second transistor T2 is in a turn-off state during the first non-light-emitting stage, when the $i^{th}$ functional signal terminal X_i is determined to be at a potential of the first non-light-emitting stage, it can be approximated to be the same as the potential of the $i^{th}$ functional signal terminal X_i in the second non-light-emitting stage. The second non-light-emitting stage refers to a stage in which the second transistor T2 is turned on in the non-light-emitting stage and a time interval between this stage and the first non-light-emitting stage is the shortest. Since the pixel driving circuit includes multiple transistors and multiple traces, and there are parasitic capacitances between different traces and/or transistors. As a result, after the $i^{th}$ functional signal terminal X_i passes through the second transistor T2 to write a signal in the second non-light-emitting stage, if the second transistor T2 is turned off and there is no other path to write a signal into the functional signal terminal, the signal will be temporarily retained by the parasitic capacitance after the second transistor T2 is turned off.

ΔV is a critical variation of the potential of the first node N1 when a preset condition is met. For example, the preset condition includes a requirement for the optical effect of the light emitting element 200. The optical effect includes parameters such as brightness and a brightness fluctuation. In embodiments of the present disclosure, the potential of the first node N1 is related to the light-emitting current of the light emitting element 200. In some embodiments of the present disclosure, the requirements for the optical effect of the light emitting element 200 can be adjusted according to different application scenarios of the display panel provided with the light emitting element 200. For example, when it is necessary to ensure that the light emitting element 200 has stable brightness to avoid the screen-shaking of the display panel, it may be set the foregoing preset condition to have a brightness fluctuation of the light emitting element 200 which may not be recognized by human eyes. That is, ΔV is a critical variation of the potential of the first node N1 under the condition that the brightness fluctuation of the light emitting element 200 is not recognized by human eyes. That is to say, if the variation of the potential of the first node N1 is greater than ΔV, the brightness fluctuation of the light emitting element may be observed by human eyes, for example, the problem of screen-shaking occurs. In some embodiments, the foregoing preset conditions include: the brightness fluctuation A of the light emitting element 200 satisfies 3%≤A≤7%. For example, the aforementioned brightness fluctuation A may satisfy 4.5%≤A≤5.5%. In some embodiments, the aforementioned brightness fluctuation A satisfies A=5%. According to the critical variation ΔV of the potential of the first node N1, the critical variation ΔQ of the charge at the first node N1 can be obtained when the preset condition is met. The critical variation ΔQ satisfies:

$$\Delta Q = C_{st} \times \Delta V \quad (3).$$

The inventor found that during the working process of the pixel driving circuit 100, when the pixel driving circuit 100 enters the light-emitting stage, the $i^{th}$ first transistor T1_*i* switches from a turn-on state to a turn-off state, its gate signal is switched from an active level to an inactive level $V_{G_off}$. The active level refers to a gate signal that turns on the $i^{th}$ first transistor T1_*i*, and the inactive level refers to a gate signal that turns off the $i^{th}$ first transistor T1_*i*. As shown in FIG. 5, due to the presence of the gate capacitor $C_0$ in the $i^{th}$ first transistor T1_*i*, after its gate signal is switched from the active level, to the inactive level $V_{G_off}$, the potential of the channel 130 of the $i^{th}$ first transistor T1_*i* will also be coupled to a potential close to the inactive level $V_{G_off}$. At this time, there is a voltage difference between the channel 130 and the first node N1, and the charges in the channel 130 may move to the first node N1, resulting in the potential of the first node N1 being affected. In the process that the potential in the channel 130 changes from the active level $V_{G_off}$ to the initial potential of the first node N1 in the light-emitting stage, the charge variation $Q_1$ in the channel 130 of the $i^{th}$ first transistor T1_*i* satisfies:

$$Q_i = C_0 \times |V_{G_off} - V_{N1}| \quad (4).$$

Since the first electrode of the $i^{th}$ first transistor T1_*i* is electrically connected to the first node N1, and the second electrode of the $i^{th}$ first transistor T1_*i* is electrically connected to the $i^{th}$ functional signal terminal X_i, after the $i^{th}$ first transistor T1_*i* is turned off, a portion of the charges in the channel 130 may flow to the first node N1, and another portion of the charges in the channel 130 may flow to the corresponding $i^{th}$ functional signal terminal X_i. The charge amount $Q_{1_i}$ moving from the channel 130 of the $i^{th}$ first transistor T1_*i* to the first node N1 and the charge amount $Q_{2_i}$ moving from the $i^{th}$ functional signal terminal X_i satisfy:

$$Q_{1_i} + Q_{2_i} = Q_i, \quad (5)$$

$$\frac{Q_{1_i}}{Q_{2_i}} = \left|\frac{\Delta U_1}{\Delta U_2}\right|, \quad (6)$$

where $\Delta U_1$ is a voltage difference between the channel 130 of the $i^{th}$ first transistor T1_*i* and the first node N1 when the $i^{th}$ first transistor T1_*i* is turned off, and $\Delta U_2$ is a voltage difference between the channel 130 of the $i^{th}$ first transistor T1_*i* and the $i^{th}$ functional signal terminal X_i when the $i^{th}$ first transistor T1_*i* is turned off. ΔU1 satisfies; $\Delta U_i = V_{G_off} - V_{N1}$; and ΔU2 satisfies: $\Delta U_2 = V_{G_off} - V_{X_i}$.

Combining the above formula (4), formula (5) and formula (6), it can be obtained that the charge amount Q1_*i* moving from the channel 130 of the $i^{th}$ first transistor T1_*i* to the first node N1 satisfies:

$$Q_{1_i} = C_{ox} \times W \times L \times \frac{\Delta U_1^2}{|\Delta U_1| + |\Delta U_2|} = C_{ox} \times W \times L \times \frac{(V_{G_off} - V_{N1})^2}{|V_{G_off} - V_{N1}| + |V_{G_off} - V_{X_i}|}. \quad (7)$$

Comprehensively considering the influence of the M first transistors T1 of the pixel driving circuit 100 on the first node N1, it can be obtained that the total charge Q1 moving from the channels of the M first transistors T1 to the first node N1 satisfies:

$$Q_1 = \sum_{i=1}^{i=M} Q_{1_i} = \sum_{i=1}^{i=M} \frac{C_{ox} \times W \times L \times (V_{G_off} - V_{N1})^2}{|V_{G_off} - V_{N1}| + |V_{G_off} - V_{X_i}|}. \quad (8)$$

If the charge amount Q1 moving to the first node N1 is greater than the critical variation ΔQ of the charge at the first node N1 when the preset conditions are met, the variation of the potential of the first node N1 may exceed the above ΔQ. That is, the optical effect of the light emitting element 200 cannot satisfy the preset conditions.

In the pixel driving circuit 100 provided by embodiments of the present disclosure, by setting the channel size of the M first transistors T1, the width W and the length L of channels of the M first transistors T1 satisfy the above formula (1), the capacitance value of the gate capacitor $C_0$ of the first transistor T1 can be reduced. After the first transistor T1 is turned off, the amount of charge flowing out from the channel 130 of the first transistor T1 can be reduced, so that the charge amount $Q_1$ flowing from the channel 130 to the first node N1 can be smaller than the critical variation ΔQ of the charge at the first node N1, which can ensure that the optical effect of the light emitting element 200 meets the set preset conditions.

For example, in a process for designing the pixel driving circuit 100, the foregoing preset conditions may be set firstly according to application scenarios of the display panel or other factors, and then the channel parameters of the first transistor T1 may be designed according to the preset conditions.

In embodiments of the present disclosure, the above storage capacitor $C_{st}$ includes a first electrode plate, a second electrode plate and a first dielectric layer. The first electrode plate and the second electrode plate are arranged opposite to each other. The first dielectric layer is located between the first electrode plate and the second electrode plate. In embodiments of the present disclosure, the first electrode plate and the second electrode plate may be parallel to each other. The gate electrode and the active layer in the above gate capacitor $C_0$ may also be parallel to each other. The length L and the width W of channel of the first transistor T1 satisfy:

$$W \times L < \frac{\varepsilon_1 \times S \times d_2 \times \Delta V}{\sum_{i=1}^{i=M} \frac{\varepsilon_2 \times d_1 \times (V_{G_off} - V_{N1})^2}{|V_{G_off} - V_{N1}| + |V_{G_off} - V_{X_i}|}}, \tag{9}$$

where, $\varepsilon_1$ is a relative dielectric constant of the first dielectric layer; S is an area of the first electrode plate directly facing the second electrode plate; $d_1$ is a thickness of the first dielectric layer; the thickness direction of the first dielectric layer is parallel to an arrangement direction of the first electrode plate and the second electrode plate of the storage capacitor $C_{st}$. $\varepsilon_2$ is a relative dielectric constant of the gate insulating layer 14 of the gate capacitor $C_0$; $d_2$ is a thickness of the gate insulating layer 14 of the gate capacitor $C_0$: the thickness direction of the gate insulating layer 14 is parallel to an arrangement direction of the gate electrode and the channel of the first transistor T1.

In some embodiments, the above first transistor T1 includes a P-type transistor. When the first transistor T1 is set as a P-type transistor, the length L and the width W of channel of the first transistor T1 satisfy:

$$W \times L < \frac{C_{st} \times \Delta V}{\sum_{i=1}^{i=M} \frac{C_{ox} \times (V_{G_off} - V_{N1})^2}{(V_{G_off} - V_{N1}) + |V_{G_off} - V_{X_i}|}}. \tag{10}$$

In some embodiments, the above first transistor T1 includes an N-type transistor. When the first transistor T1 is set as an N-type transistor, the length L and the width W of channel of the first transistor T1 satisfy:

$$W \times L < \frac{C_{st} \times \Delta V}{\sum_{i=1}^{i=M} \frac{C_{ox} \times (V_{G_off} - V_{N1})^2}{(V_{N1} - V_{G_off}) + |V_{G_off} - V_{X_i}|}}. \tag{11}$$

When the second transistor T2 electrically connected to the second electrode of the first transistor T1 is provided. For example, for the first transistor T1 and the second transistor T2 that are connected to each other, in embodiments of the present disclosure, the channel length of the second transistor T2 may be greater than or equal to the channel length of the first transistor T1. For example, the channel length of the second transistor T2 may be greater than the channel length of the first transistor T1, or the channel length of the second transistor T2 may be equal to the channel length of the first transistor T1. Since a distance between the second transistor T2 and the first node N1 is relatively large, and a distance between the first transistor T1 and the first node N1 is relatively large, the channel length of the second transistor T2 is greater than or equal to the channel length of the first transistor T1, so that the second transistor T2 can have a small off-state leakage current, thereby achieving a stable potential of the first node N1 during the light-emitting stage.

According to the working requirements of the pixel driving circuit 100, in embodiments of the present disclosure, the gate electrode of the first transistor T1 may be electrically connected to the gate electrode of the second transistor T2. That is, a control signal S1 for controlling the first first transistor T1_1 in FIG. 2 and a control signal S0 for controlling the second transistor 12 are the same, and the first transistor T1 and the second transistor T2 that are connected to each other form a dual-gate transistor. Alternatively, embodiments of the present disclosure may also use different signals to control the first transistor T1 and the second transistor T2, respectively.

In some embodiments, the foregoing M first transistors T1 at least include a first node reset transistor. Correspondingly, the above at least one function signal terminal X is configured to receive the first reset signal Vref1 for resetting the first node N1. Referring to FIG. 1, the pixel driving circuit 100 includes two first transistors T1. For example, the first first transistor T1_1 is the first node reset transistor, the above first functional signal terminal X_1 is configured to receive the first reset Signal Vref1. The gate electrode of the first first transistor T1_1 is electrically connected to a first scan signal terminal S1. During a process for operating the pixel driving circuit, the above N non-light-emitting stages at least include a first node reset stage. In the first node reset stage, the first first transistor T1_1 is controlled to be turned on to reset the first node N1 by using the first reset signal Vref1. In some other embodiments, the first reset signal Vref1 may be a constant signal.

In some embodiments, the foregoing M first transistors T1 at least include a threshold compensation transistor. Correspondingly, the aforementioned at least one functional signal terminal X is configured to receive a threshold compensation signal. Referring to FIG. 1, taking the pixel driving circuit 100 including two first transistors T1 as an example, the second first transistor T1_2 may be a threshold compensation transistor, and the above second functional signal terminal X_2 is configured to receive the threshold compensation signal. The threshold compensation signal refers to a signal related to the threshold voltage of the driving transistor T0. The above N non-light emitting stages include at least a threshold compensation stage. In the threshold compensation stage, the second first transistor T1_2 is controlled to be turned on to write the threshold compensation signal into the first node N1. In the subsequent light-emitting stage, the influence of the threshold voltage on the on-current of the driving transistor T0 is eliminated.

As shown in FIG. 4, the second first transistor T1_2 is a threshold compensation transistor, and the third node N3 is used as the above second functional signal terminal X_2. In the threshold compensation stage, the signal of the third node N3 is a signal related to the threshold voltage of the driving transistor T0. The second electrode of the second first transistor T1_2 is electrically connected to the third node N3, and the gate electrode of the second first transistor T1_2 is electrically connected to a second scan signal terminal S2. In the threshold compensation stage, the second first transistor T1_2 is controlled to be turned on, so that the signal of the third node N3 is written into the first node N1.

In some embodiments, the aforementioned pixel driving circuit further includes a data writing module and a light emitting control module.

As shown in FIG. 1, FIG. 2, FIG. 3, and FIG. 4, one end of the data writing module 31 is coupled to the data signal terminal Vdata, and the other end of the data writing module 31 is electrically connected to the second node N2. During a process for operating the pixel driving circuit 100, the above N non-light emitting stages at least include a data writing stage. In the data writing stage, the data writing module 31 responds to the third scan signal S3 to write a data voltage provided by the data signal terminal Vdata into the second node N2.

The lighting control module includes a first lighting control module 321 and a second lighting control module 322. One end of the first lighting control module 321 is coupled to a first power supply voltage terminal PVDD, and the other end of the first lighting control module 321 is electrically connected to the second node N2. One end of the second light emitting control module 322 is electrically connected to the third node N3, and the other end of the second light emitting control module 322 is coupled to the light emitting element 200. During a process for operating the pixel driving circuit 100, in the light-emitting stage, the first light emitting control module 321 responds to the first light emitting control signal E1 to write a signal of the first power supply voltage terminal PVDD into the second node N2. The second light emitting control module 322 responds to a second light emitting control signal E2 to write a signal of the third node N3 into the light emitting element 200.

Figure 6:
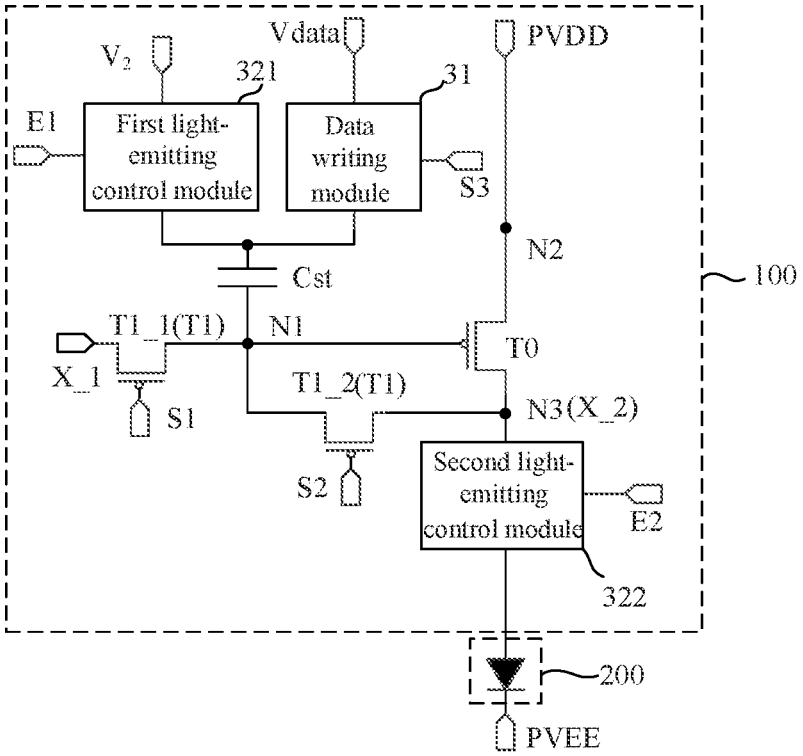
FIG. 6 is another schematic diagram of a pixel driving circuit according to an embodiment of the present disclosure.

FIG. 6 is another schematic diagram of a pixel driving circuit according to an embodiment of the present disclosure. As shown in FIG. 6, one end of the data writing module 31 is coupled to the data signal terminal Vdata, and the other end of the data writing module 31 is electrically connected to a second electrode plate of the storage capacitor $C_{st}$. One end of the first light emitting control module 321 is also electrically connected to a second electrode plate of the storage capacitor $C_{st}$, and the other end of the first light emitting control module 321 is electrically connected to a second constant signal terminal $V_2$. One end of the second light emitting control module 122 is electrically connected to a third node N3, and the other end of the second light emitting control module 122 is electrically connected to the light emitting element 200. During a process for operating the pixel driving circuit 100, the above N non-light-emitting stages at least include a first charging stage, and the above light-emitting stage at least includes a second charging stage. In the first charging stage, in embodiments of the present disclosure, the data voltage provided by the data signal terminal Vdata charges the storage capacitor $C_{st}$ for the first time through the data writing module 31. In the second charging stage, the second constant signal provided by the second constant signal terminal $V_2$ can charge the storage capacitor $C_{st}$ for the second time through the first light emitting control module 321. According to the bootstrap effect of the capacitor, the voltage variations at two ends of the storage capacitor $C_{st}$ are the same. Therefore, the potential of the first node N1 in the second charging stage is related to the data voltage and the second constant signal. In embodiments of the present disclosure, the second charging stage and the light-emitting stage can be performed at the same time, so that the potential of the first node N1 in the light-emitting stage can be adjusted by adjusting the data voltage.

In some embodiments, as shown in FIG. 1, FIG. 2, FIG. 3, and FIG. 4, the above pixel driving circuit 100 further includes a light emitting element reset module 33 configured to connect the second reset signal terminal Vref2 to the light emitting element 200. The aforementioned non-light-emitting stage further includes a light emitting element reset stage. In the light emitting element reset stage, the light emitting element reset module 33 is turned on under the control of a fourth scan signal S4, and writes the second reset signal Vref2 into the light emitting element 200 in order to avoid the light emitting element 200 from being unintentionally lighted.

Figure 7:
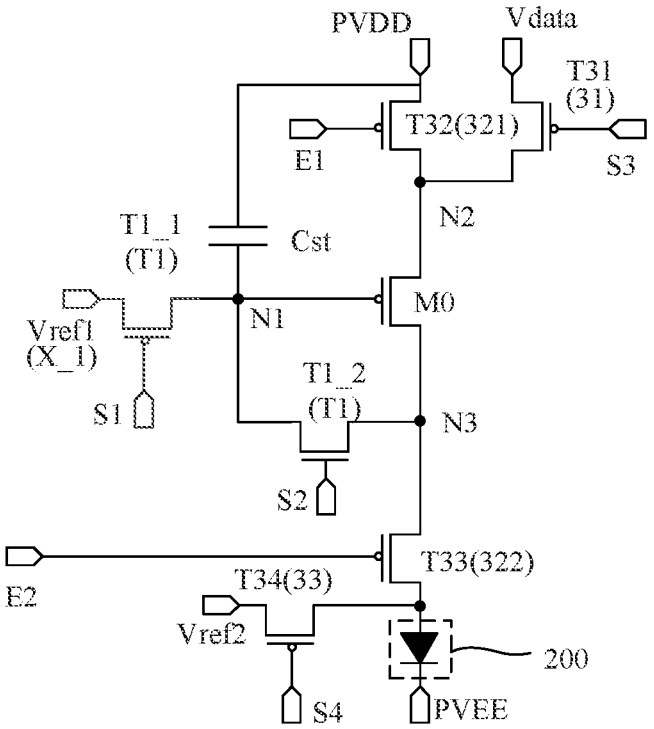
FIG. 7 is another schematic diagram of a pixel driving circuit according to an embodiment of the present disclosure.

FIG. 7 is another schematic diagram of a pixel driving circuit according to an embodiment of the present disclosure. As shown in FIG. 7, the first light emitting control module 321 includes a first control transistor T32. The second light emitting control module 322 includes a second control transistor T33. A gate electrode of the first control transistor T32 is electrically connected to a first light emitting control signal terminal E1, a gate electrode of the second control transistor T33 is electrically connected to a second light emitting control signal terminal E2. A first electrode of the first control transistor T32 is coupled to a first power supply voltage signal terminal PVDD. A second electrode of the first control transistor T32 is electrically connected to a second node N2. A first electrode of the second control transistor T33 is coupled to a third node N3. A second control transistor T33 is electrically connected to the light emitting element 200.

The light emitting element reset module 33 includes a light emitting element reset transistor T34. A first electrode of the light emitting element reset transistor T34 is coupled to a second reset signal terminal Vref2, a second electrode of the light emitting element reset transistor T34 is electrically connected to the light emitting element 200, and a gate electrode of the light emitting element reset transistor T34 is electrically connected to a fourth scan signal terminal S4. In some embodiments, the fourth scan signal terminal may be electrically connected to the first scan signal terminal or the second scan signal terminal.

The data writing module 31 includes a data writing transistor T31. A first electrode of the data writing transistor T31 is coupled to a data signal terminal Vdata, a second electrode of the data writing transistor T31 is electrically connected to the second node N2, and a gate electrode of the data writing transistor T31 is electrically connected to a third scan signal terminal S3.

Figure 8:
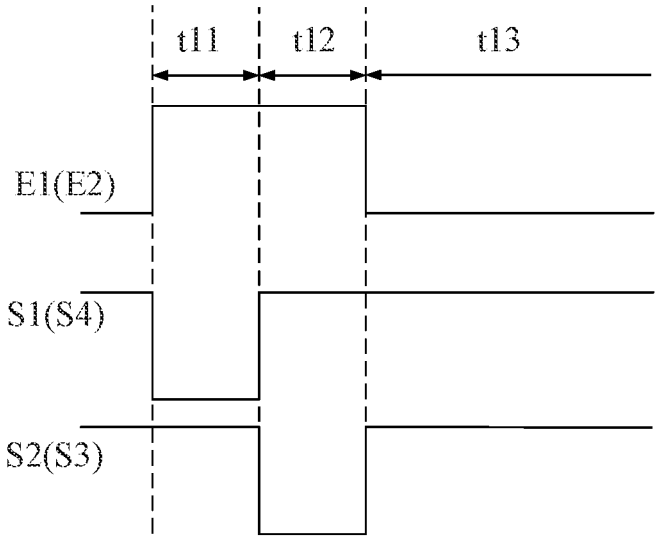
FIG. 8 is a timing sequence diagram corresponding to FIG. 7.

In some embodiments of the present disclosure, a first light emitting control signal E1 is electrically connected to a second light emitting control signal terminal E2, the fourth scan signal terminal S4 is electrically connected to the first scan signal terminal S1, and the third scan signal terminal S3 is electrically connected to the second scan signal terminal S2. FIG. 8 is a timing sequence diagram corresponding to FIG. 7. As shown in FIG. 8, a driving cycle of the pixel driving circuit 100 includes a light-emitting stage t13 and two non-light-emitting stages. The two non-light emitting stages are a reset stage t11 and a data writing and threshold compensation stage t12, respectively.

In the reset stage t11, the first first transistor T1_1 and the light emitting element reset transistor T34 are turned on to reset the first node N1 and the light emitting element 200, respectively.

In the data writing and threshold compensation stage t12, the data writing transistor T31 is turned on, and the data voltage provided by the data signal terminal Vdata is written into the second node N2, $V_{N2}=V_{data}$. When the second first transistor T1_2 is turned on. $V_{N3}=V_{N1}$, the driving transistor T0 is turned on, and there is a current flowing from the second node N2 to the first node N1 in the driving transistor T0. In this process, the potential of the first node N1 changes continuously until the potential of the first node N1 is $V_{N1}=V_{data}-|V_{th}|$, where $V_{th}$ is a threshold voltage of the driving transistor T0. At this time, $V_{N3}=V_{N1}=V_{data}-|V_{th}|$.

In the light-emitting stage t13, the first control transistor T32 and the second control transistor T33 are turned on, and the first first transistor T1_1 and the second first transistor T1_2 are both turned off, $V_{N2}=V_{PVDD}$. The first electrode plate of the storage capacitor $C_{st}$ is electrically connected to the first node N1, and the second electrode plate is electrically connected to the first constant signal terminal $V_1$. Therefore, in the light-emitting stage, the potential of the first node N1 can be maintained by the storage capacitor $C_{st}$, i.e., when the light emitting element 200 emits light, the initial potential of the first node N1 satisfies: $V_{N1}=V_{data}-|V_{th}|$. In some embodiments, the above first constant signal terminal $V_1$ may be electrically connected to the first power supply voltage terminal PVDD.

The pixel driving circuit shown in FIG. 7 includes a first first transistor T1_1 and a second first transistor T1_2. A signal of the first functional signal terminal X_1 connected to the first first transistor T1_1 may be a constant signal $V_{ref1}$. The second functional signal terminal X_2 connected to the second first transistor T1_2 is the third node N3. A signal of the third node N3 in the data writing and threshold compensation stage t12 is $V_{N3}=V_{data}-|V_{th}|$. Therefore, based on the pixel driving circuit shown in FIG. 7, when the channels of the first first transistor T1_1 and the second first transistor T1_2 are designed according to the above formula (1), the potential $V_{X_1}$, of the first functional signal terminal X_1 in the first non-light-emitting stage in the formula (1) is the potential $V_{ref1}$ of the first functional signal terminal X_1 in the data writing and threshold compensation stage t12, and the potential $V_{X_2}$, of the second functional signal terminal X_2 in the first non-light-emitting stage is the potential $V_{data}-|V_{th}|$ of the node N3 in the data writing and threshold compensation stage t12. Taking the first transistor T1_1 and the second first transistor T1_2 being both P-type transistors as an example, the width and length of channels of the first transistor T1_1 and the second first transistor T1_2 shall satisfy:

$$W \times L < \frac{C_{st} \times \Delta V}{\frac{C_{ox} \times (V_{G_off} - V_{N1})^2}{2V_{G_off} \sim V_{N1} \sim V_{ref1}} + \frac{C_{ox} \times (V_{G_off} - V_{N1})}{2}}.$$

Figure 9:
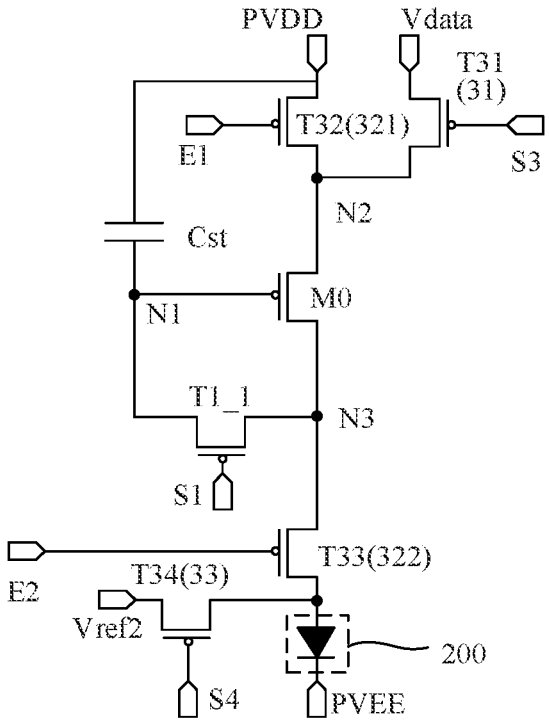
FIG. 9 is another schematic diagram of a pixel driving circuit according to an embodiment of the present disclosure.
Figure 10:
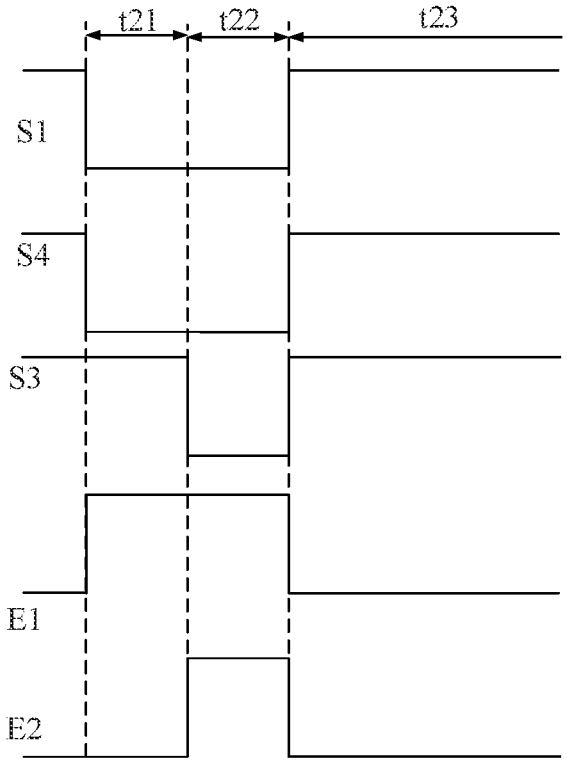
FIG. 10 is a timing sequence diagram corresponding to FIG. 9.

FIG. 9 is another schematic diagram of a pixel driving circuit according to an embodiment of the present disclosure, and FIG. 10 is a timing sequence diagram corresponding to FIG. 9. Alternatively, as shown in FIG. 9 and FIG. 10, the pixel driving circuit shown in FIG. 9, only one first transistor T1_1 is provided. The second electrode of the first transistor T1_I is electrically connected to the third node N3, that is, N3 serves as a functional signal terminal. A driving cycle of the pixel driving circuit includes a light-emitting stage t23 and two non-light-emitting stages. The two non-light emitting stages are a reset stage t21 and a data writing and threshold compensation stage t22, respectively.

In the reset stage t21, the light emitting element reset transistor T34, the second control transistor T33, and the first transistor T1_1 are turned on, and the second reset signal Vref2 is written into the first Node N1 through the light emitting element reset transistor T34, the second control transistor T33 and the first transistor T1_*i* to reset the first node N1. $V_{N1}=V_{ref2}$. At the same time, the light emitting element 200 can also be reset at this stage.

In the data writing and threshold compensation stage t22, the data writing transistor T31, the driving transistor T0, the first transistor T1_1, and the light emitting element reset transistor T34 are turned on, $V_{N2}=V_{PVDD}$, and $V_{N3}=V_{N1}=V_{data}-|V_{th}|$. At the same time, the light emitting element 200 can also be reset at this stage.

In the light-emitting stage t23, the first control transistor T32 and the second control transistor T33 are turned on, $V_{N2}=V_{PVDD}$, and $V_{N1}=V_{data}-|V_{th}|$.

It can be seen that, based on the pixel driving circuit shown in FIG. 9, the light emitting element reset transistor T34, the second control transistor T33, and the first transistor T1_1 can achieve a function of resetting the first node N1. With such a configuration, it is not necessary to additionally provide a transistor to reset the first node N1, which is beneficial to reducing the number of transistors of the pixel driving circuit 100.

In the pixel driving circuit shown in FIG. 9, the third node N3 is written as a second reset signal Vref2 through the light emitting element reset transistor T34, the second control transistor T33, and the first first transistor T1_1 in the reset stage t21. In the data writing and threshold compensation stage t22, the third node N3 is written as $V_{data}-|V_{th}|$ through the data writing transistor T31 and the driving transistor T0. Since the data writing and threshold compensation stage t22 is adjacent to the light-emitting stage t23, based on the pixel driving circuit shown in FIG. 9, when the channels of the first transistor T1_1 are designed according to the above formula (1), the potential $v_{X_i}$, of the $i^{th}$ functional signal terminal X_i in the first non-light-emitting stage in the formula (1) is the potential of the third node N3 in the data writing and threshold compensation stage t22. Taking the first transistor T1 being a P-type transistor as an example, the width and length of channels of the first transistor T1 shall satisfy:

$$W \times L < \frac{2C_{st} \times \Delta V}{C_{ox} \times (V_{G_off} - V_{N1})}.$$

Figure 11:
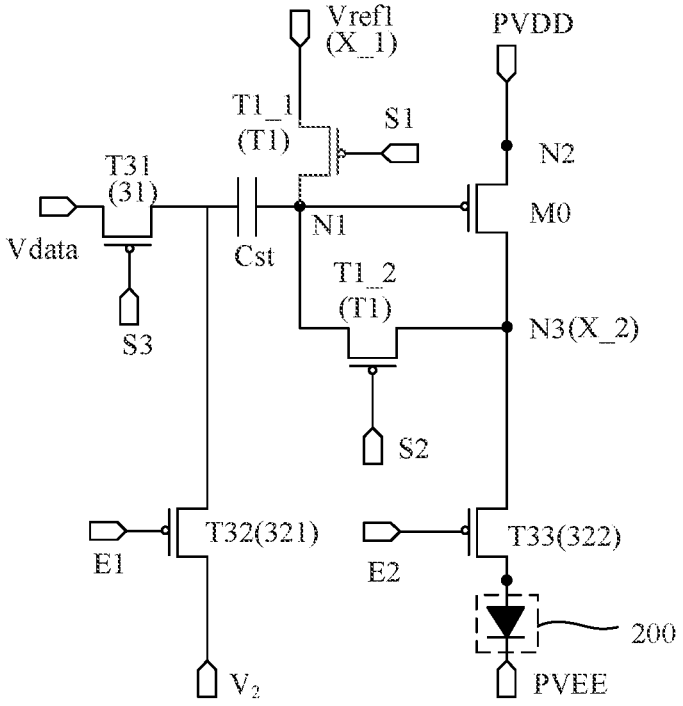
FIG. 11 is another schematic diagram of a pixel driving circuit according to an embodiment of the present disclosure.
Figure 12:
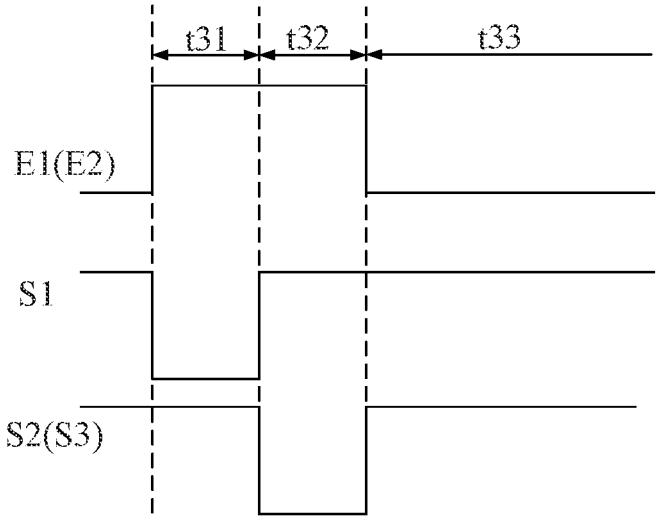
FIG. 12 is a timing sequence diagram corresponding to FIG. 11.

FIG. 11 is another schematic diagram of a pixel driving circuit according to an embodiment of the present disclosure, and FIG. 12 is a timing sequence diagram corresponding to FIG. 11. In some embodiments, as shown in FIG. 11 and FIG. 12, two first transistors are included. A first functional signal terminal X_1 connected to the second electrode of the first first transistor T1_1 is connected to the first reset signal Vref1. The second functional signal terminal X_2 connected to the second electrode of the second first transistor T1_2 is connected to the third node N3. The first electrode plate of the storage capacitor $C_{st}$ is electrically connected to the first node N1, and the second electrode plate of the storage capacitor $C_{st}$ is electrically connected to the data signal terminal Vdata through the data signal writing module 31. The first light emitting control module 321 includes a first control transistor T31. The second light emitting control module 322 includes a second control transistor T32. A gate electrode of the first control transistor T31 is electrically connected to the first light emitting control signal terminal E1. A gate electrode of the second control transistor T32 is electrically connected to the second light emitting control signal terminal E2. A first electrode of the first control transistor T31 is coupled to the second signal terminal $V_2$, and a second electrode of the first control transistor T31 is connected to the second electrode plate of the storage capacitor $C_{st}$. A first electrode of the second control transistor T32 is coupled to the third node N3, and a second electrode of the second control transistor T32 is electrically connected to the light emitting element 200. The above data writing module 31 includes a data writing transistor T31. A first electrode of the data writing transistor T31 is coupled to the data signal terminal Vdata, a second electrode of the data writing transistor T31 is electrically connected to the second electrode plate of the storage capacitor $C_{st}$, and a gate electrode of the data writing transistor T31 is connected to the third scanning signal terminal S3.

In some embodiments of the present disclosure, the first light emitting control signal E1 is electrically connected to the second light emitting control signal E2, and the third scan signal terminal S3 is electrically connected to the second scan signal terminal S2. When the pixel driving circuit is operating, the driving cycle of the pixel driving circuit includes a light-emitting stage t33 and two non-light-emitting stages. The two non-light-emitting stages are a reset stage t31 and a data writing and threshold compensation stage t32, respectively.

In the reset stage t31, the first first transistor T1_1 is turned on to reset the first node N1 by using the first reset signal Vref1, $V_{N3}=V_{Ref1}$.

In the data writing and threshold compensation stage t32, the data writing transistor T31 is turned on, and the storage capacitor $C_{st}$ is charged by using the data signal Vdata. The second electrode plate of the storage capacitor $C_{st}$ is written with the data signal $V_{data}$. At the same time, the second first transistor T1_2 is turned on, $V_{N3}=V_{N1}$. At this time, the driving transistor T0 is turned on, and there is a current from the second node N2 to the first node N1 in the driving transistor T0. The power supply voltage provided by the first power supply voltage signal terminal PVDD is written into the second node N2, $V_{N2}=V_{PVDD}$. In this process, the potential of the first node N1 changes continuously until the potential of the first node N1 is $V_{N1}=V_{PVDD}-|V_{th}|$, where $V_{th}$ is a threshold voltage of the driving transistor T0.

In the light-emitting stage t23, the first first transistor T1_1 and the second first transistor T1_2 are both turned off. The first control transistor T32 is turned on, the second constant signal $V_2$ charges the storage capacitor $C_{st}$ for a second time, and the second electrode plate of the storage capacitor $C_{st}$ is written with the second constant signal $V_2$. According to the bootstrap effect of the capacitor, the voltage variations at both ends of the storage capacitor $C_{st}$ are the same. That is, $V_{data}-V_2=V_{PVDD}-|V_{th}|-V_{N1}$, where $V_{N1}$ is an initial potential of the first node N1 when the light emitting element 200 emits light. It is obtained: $V_{N1}=V_{PVDD}-|V_{th}|-V_{data}+V_2$.

For example, the above first reset signal Vref1 may be a constant signal. In the first non-light emitting stage, that is, in the data writing and threshold compensation stage t32 adjacent to the light emitting stage t23, the signal of the second electrode of the first first transistor T1_1 is still the first reset signal Vref1. The third node N3 has different signals at different working stages of the pixel driving circuit. In the first non-light-emitting stage, that is, in the data writing and threshold compensation stage t32, the signal of the second electrode of the second first transistor T1_1 is $V_{N3}=V_{N1}=V_{PVDD}-|Vth|$.

Taking the first transistor T1_1 and the second first transistor T1_2 both being P-type transistors as an example, when the channels of two first transistors T1 in FIG. 11 are designed according to the above formula (1), the width and length of the channels of the two first transistors T1 shall satisfy:

$$W \times L < \frac{C_{st} \times \Delta V}{\frac{C_{ox} \times (V_{G_off} - V_{N1})^2}{2V_{G_off} \sim V_{N1} \sim V_{ref1}} + \frac{C_{ox} \times (V_{G_off} - V_{N1})}{2}}.$$

Figure 13:
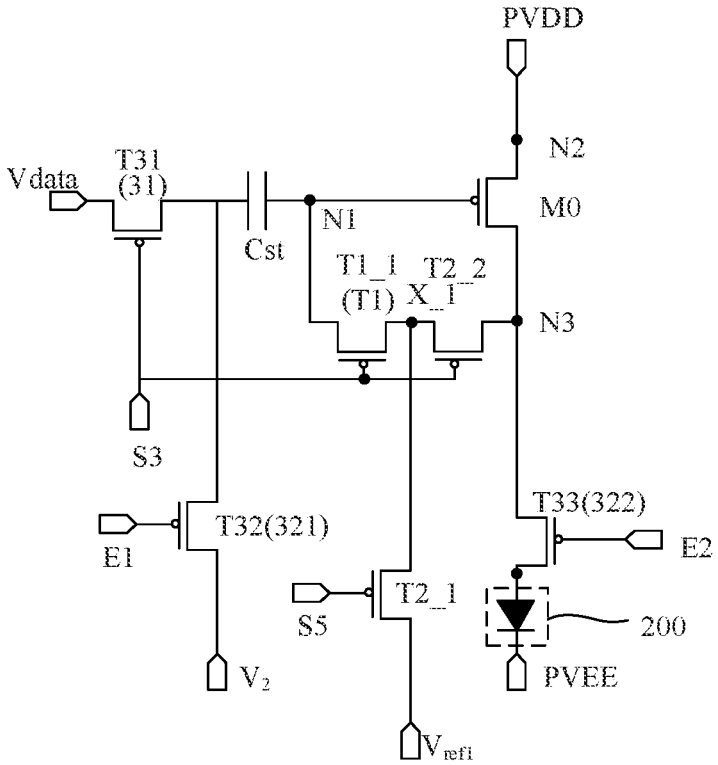
FIG. 13 is another schematic diagram of a pixel driving circuit according to an diagram embodiment of the present disclosure.
Figure 14:
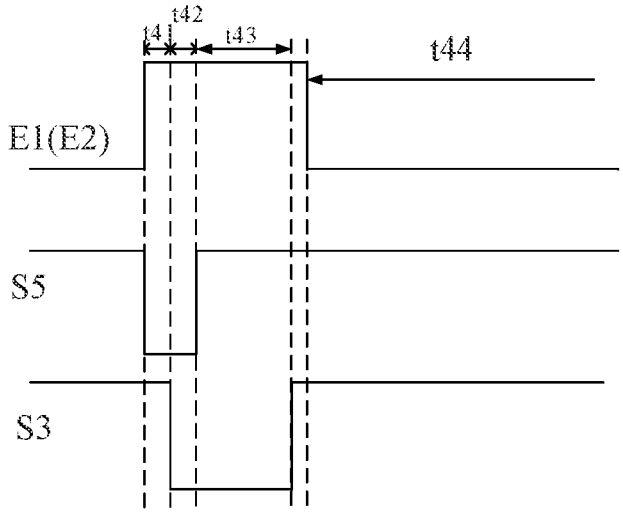
FIG. 14 is a timing sequence diagram corresponding to FIG. 13.

FIG. 13 is another schematic diagram of a pixel driving circuit according to an diagram embodiment of the present disclosure, and FIG. 14 is a timing sequence diagram corresponding to FIG. 13. Alternatively, as shown in FIG. 13 and FIG. 14, a first transistor T1_1 and two second transistors T2 are included. The two second transistors are a first second transistor T2_1 and a second second transistor T2_2, respectively. A second electrode of the first transistor T1_1, that is, the function signal terminal X_1, is electrically connected to the first reset signal terminal $V_{ref1}$ through the first second transistor T2_1. A second electrode of the first transistor T1_1, that is, the function signal terminal X_1, is also electrically connected to the third node N3 through the second second transistor T2_2. For example, a gate electrode of the first second transistor T2_1 and a gate electrode of the first transistor T1_1 may be connected to different signals. For example, the gate electrode of the first second transistor T2_1 is connected to a fifth scan signal terminal S5, and the gate electrode of the first transistor T1_I is connected to a third scan signal terminal S3. In some embodiments, the gate electrode of the second second transistor 12_2 and the gate electrode of the first transistor T1_1 may be connected to the same signal. For example, the gate electrode of the second second transistor T2_2 and the gate electrode of the first transistor T1_1 may both be connected to the third scan signal terminal S3. The gate electrode of the data writing transistor T31 is electrically connected to the third scan signal terminal S3.

A duty cycle of the pixel driving circuit includes a light-emitting stage t44 and three non-light-emitting stages. The three non-light-emitting stages are respectively a first stage t41, a second stage t42, and a third stage 43.

In the first stage t41, the first second transistor T2_1 is turned on, and the first reset signal Vref1 is written into the function signal terminal X_1, $V_{X_1}=V_{ref1}$.

In the second stage t42, the first second transistor T2_1 and the first transistor T1_1 are turned on, and a signal of the functional signal terminal X_1 is written into the first node N1 through the first transistor T1_1, $V_{N1}=V_{ref1}$. The data writing transistor T31 is turned on, and the data signal $V_{data}$ charges the storage capacitor $C_{st}$.

Subsequently, the working cycle enters the third stage 43. In the third stage t43, the second second transistor T2_2 and the first transistor T1_1 are still turned on, and the potential of the first node N1 changes continuously until the potential of the first node N1 changes to $V_{N1}=V_{PVDD}-|V_{th}|$. At this stage, the data writing transistor T31 continues to be turned on, and the data signal Vdata continues to charge the storage capacitor $C_{st}$.

In the light-emitting stage t44, the second constant signal $V_2$ is written into the storage capacitor $C_{st}$. Since the second constant signal $V_2$ is different from the data signal $V_{data}$, according to the bootstrap effect of the capacitor, it can be obtained that the initial potential of the first node N1 in the light-emitting stage t44 satisfies: $V_{N1}=V_{PVDD}-|V_{th}|-V_{data}+V_2$.

Based on the pixel driving circuit shown in FIG. 13, when the channel of the first transistor T1_1 is designed according to the above formula (1), since the signal of the functional signal terminal X_1 has different potentials in different non-light-emitting stages, the third stage t43 is adjacent to the light-emitting stage t44. Based on the pixel driving circuit shown in FIG. 13, when the channel of the first transistor T1_1 is designed according to the above formula (1), the potential $V_{X_i}$ of the $i^{th}$ functional signal terminal X_i in the first non-light-emitting stage in the formula (1) is a potential of the functional signal terminal X_1 in the third stage t43, and the potential of the functional signal terminal X_1 in the third stage t43 is the same as the potential of the third node N3 in the third stage t43. When the first transistor T1_1 is a P-type transistor, the width and length of the channels of the first transistor T1_1 shall satisfy:

$$W \times L < \frac{2C_{st} \times \Delta V}{C_{ox} \times (V_{G_off} - V_{N1})}.$$

An embodiment of the present disclosure further provides a display panel. The display panel includes a plurality of pixel driving circuits 100 described above. The specific structure of the pixel driving circuit 100 has been described in detail in the above embodiments, which will not be elaborated here.

Figure 15:
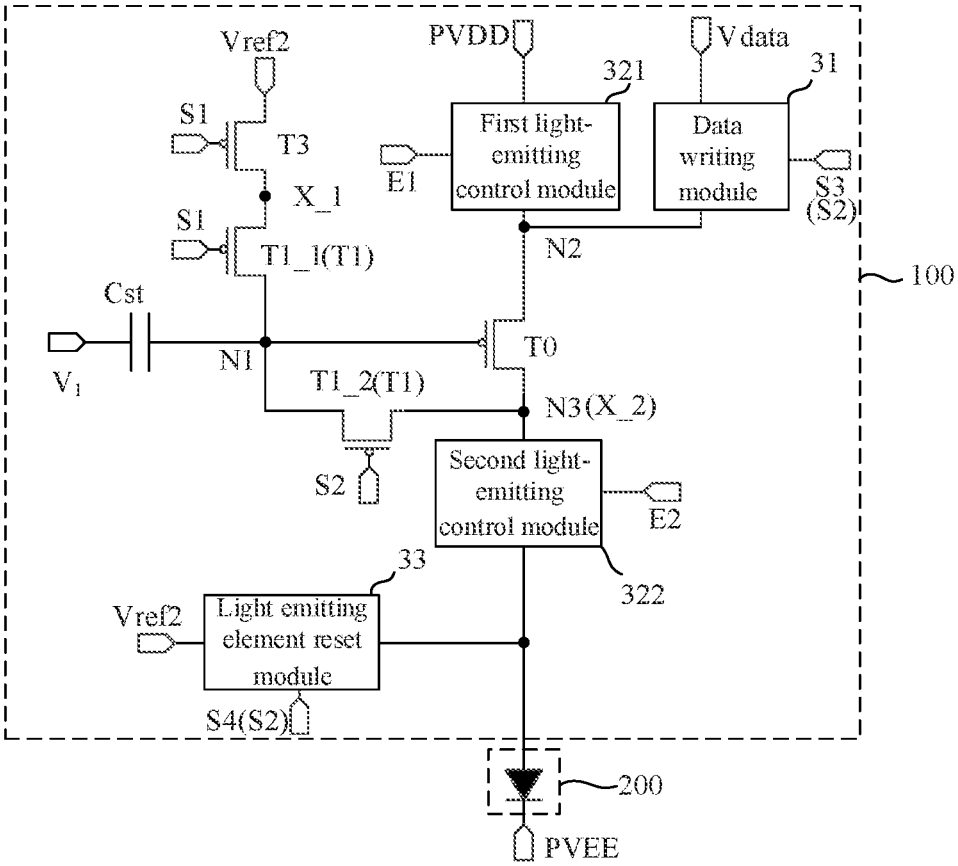
FIG. 15 is a schematic diagram of a pixel driving circuit of a display panel according to an embodiment of the present disclosure.

FIG. 15 is a schematic diagram of a pixel driving circuit of a display panel according to an embodiment of the present disclosure. In some embodiments, as shown in FIG. 15, the pixel driving circuit 100 further includes a light emitting element reset module 33 and a third transistor T3. The reset module 33 is configured to connect the second reset signal terminal Vref2 to the light emitting element 200. A first electrode of the third transistor T3 is electrically connected to a second electrode of the at least one first transistor T1. FIG. 15 schematically shows that the pixel driving circuit 100 includes a first first transistor T1_1 and a second first transistor T1_2, and the first electrode of the third transistor T3 is electrically connected to the second electrode of the first first transistor T1_1, i.e., the first electrode of the third transistor T3 is electrically connected to the first functional signal terminal X_1. In embodiments of the present disclosure, the second electrode of the third transistor T3 is coupled to the second reset signal terminal Vref2. When the first node N1 is reset, the third transistor T3 and the first first transistor T1_1 are controlled to be turned on to write the second reset signal provided by the second reset signal terminal Vref2 into the first node N1. With such a configuration, the same reset signal can be used to reset the first node N1 and the light emitting element 200, which can simplify the signal types required by the display panel. In addition, with such a configuration, the first transistor T1 is connected to the second reset signal terminal Vref2 through the third transistor T3, so that the influence of the second reset signal terminal Vref2 on the leakage current of the first node N1 during the light-emitting stage can also be reduced, thereby achieving a stable potential of the first node N1 during the light-emitting stage.

In some embodiments, based on the pixel driving circuit shown in FIG. 15, the fourth scan signal S4 for controlling the light emitting element reset module 33 is the same as the second scan signal S2 for controlling the second first transistor T1_2, and the third scan signal S3 for controlling the data writing module 31 is the same as the second scan signal S2 for controlling the second first transistor T1_2, thereby further simplifying the signal types required by the display panel.

Figure 16:
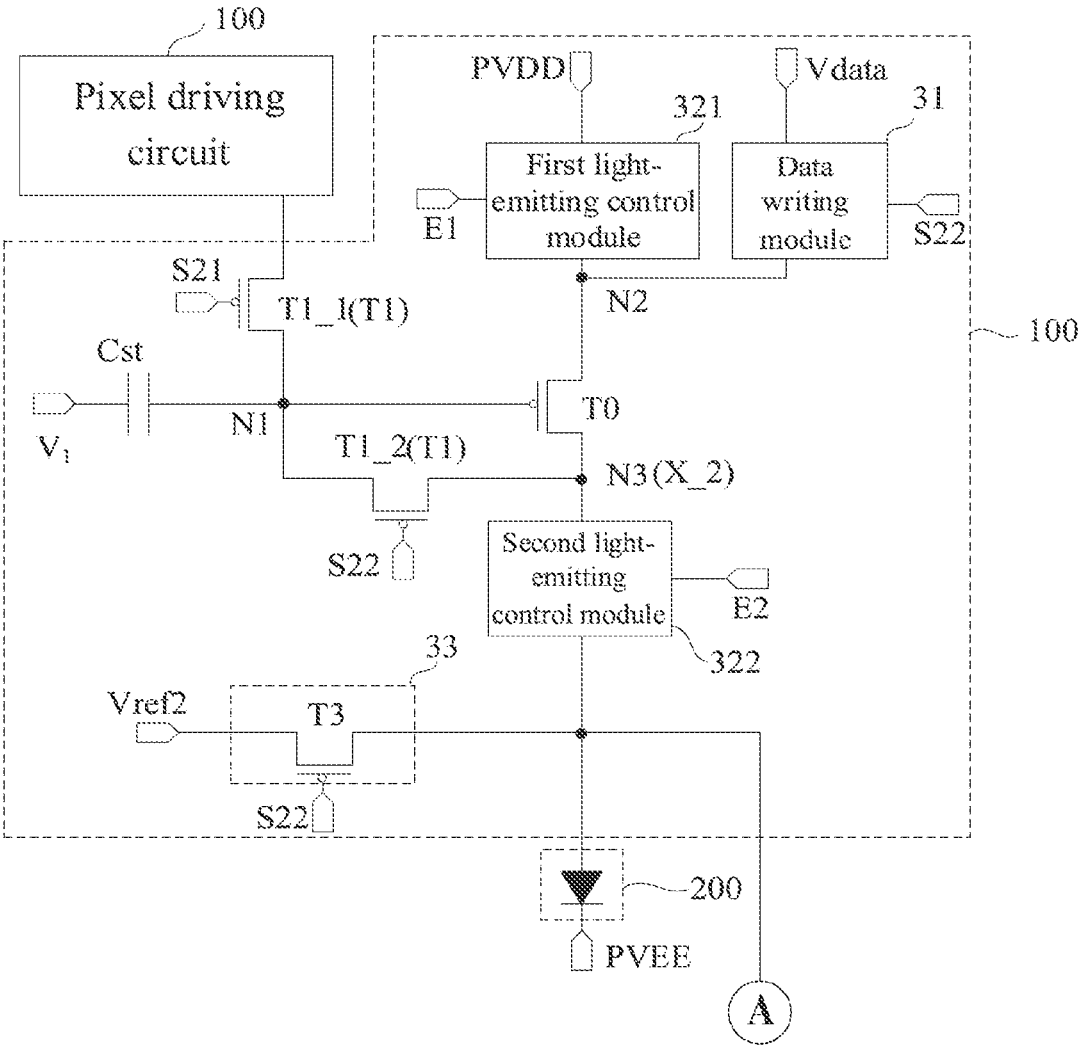
FIG. 16 is a schematic diagram showing connection relationship of multiple pixel driving circuits of a display panel according to an embodiment of the present disclosure.
Figure 16:
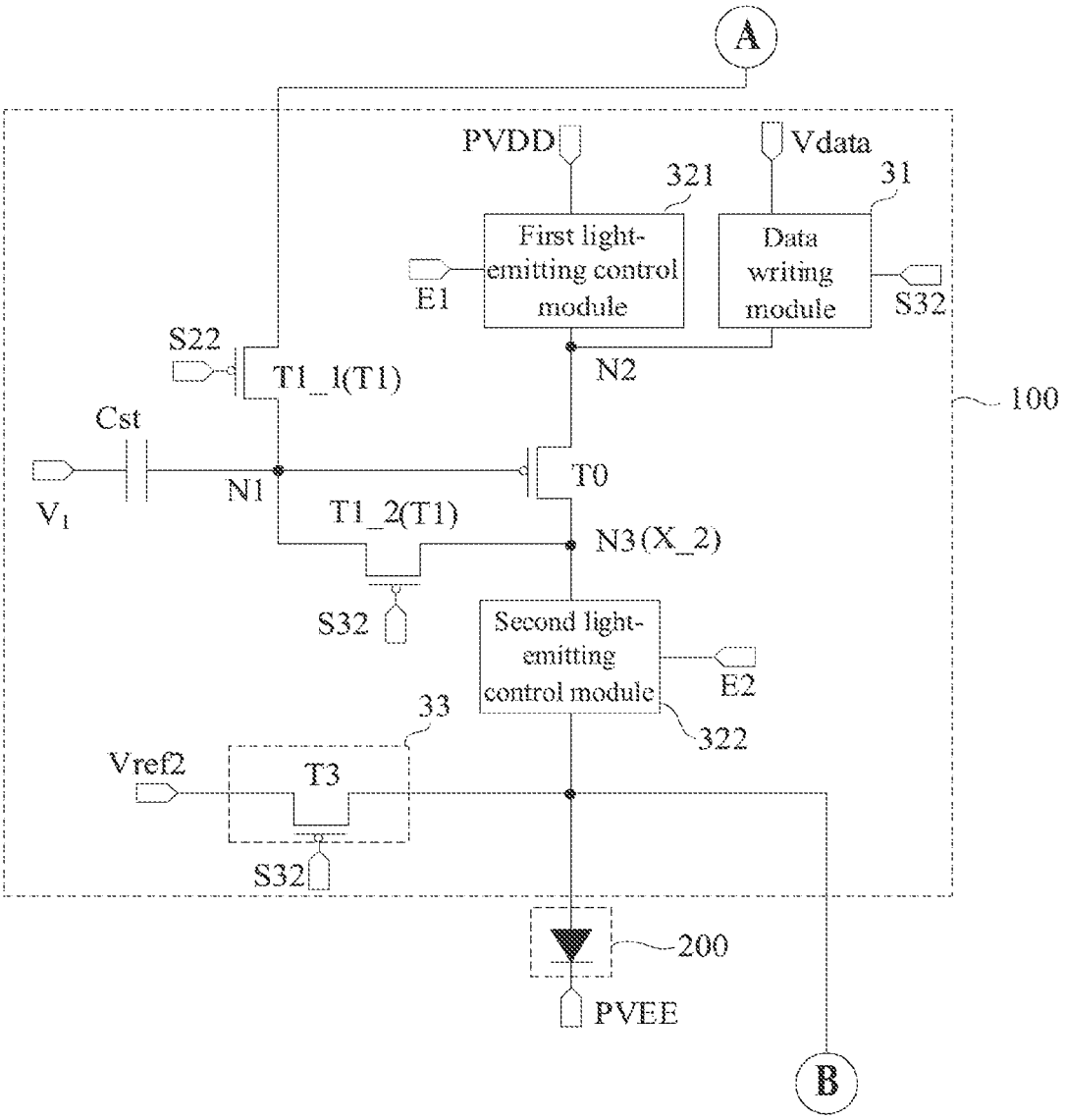
Figure 16:
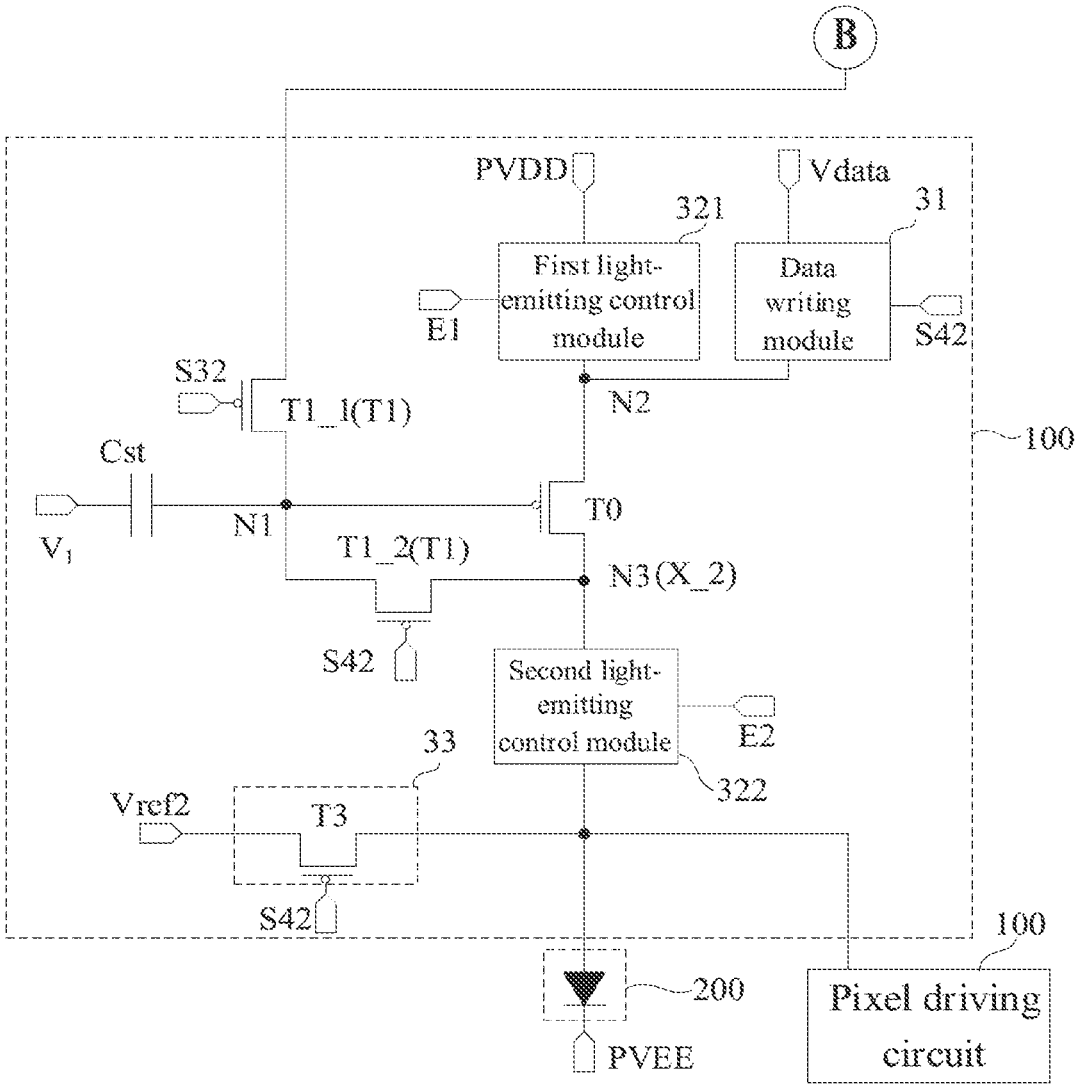

In some embodiments, the light emitting element reset module 33 of the pixel driving circuit may include a light emitting element reset transistor. FIG. 16 is a schematic diagram of a connection relationship of multiple pixel driving circuits of a display panel according to an embodiment of the present disclosure. As shown in FIG. 16, when multiple pixel driving circuits 100 of the display panel are provided, a third transistor T3 of one pixel driving circuit 100 is reused as a light emitting element reset module 33 of another pixel driving circuit. That is, for at least one pixel driving circuit 100 of the display panel, the light emitting element reset transistor is not only connected to the light emitting element 200 connected to the pixel driving circuit 100, but also electrically connected to the second electrode of at least first transistor T1 of another pixel driving circuit 100. With such a configuration, while resetting the first node N1 of a certain pixel driving circuit 100, the same reset signal resets the light emitting element 200 of another pixel driving circuit 100, so that the influence of the second reset signal terminal Vref2 on the leakage current of the first node N1 during the light-emitting stage is reduced while it is also beneficial to simplify the signal types required for the operation of the display panel and reduce the number of transistors of the pixel driving circuit.

For example, in the multiple pixel driving circuits shown in FIG. 16, the control signal of the light emitting element reset module 33, the control signal of the second first transistor T1_2, and the control signal of the data writing module 31 in the same pixel driving circuit are the same, and the control signals are denoted as S22, S32, and S42 in three pixel driving circuits in FIG. 16, respectively. The control signals for controlling the first first transistor T1_1 in the three pixel driving circuits in FIG. 16 are denoted as S21, S22, and S32, respectively.

Figure 17:
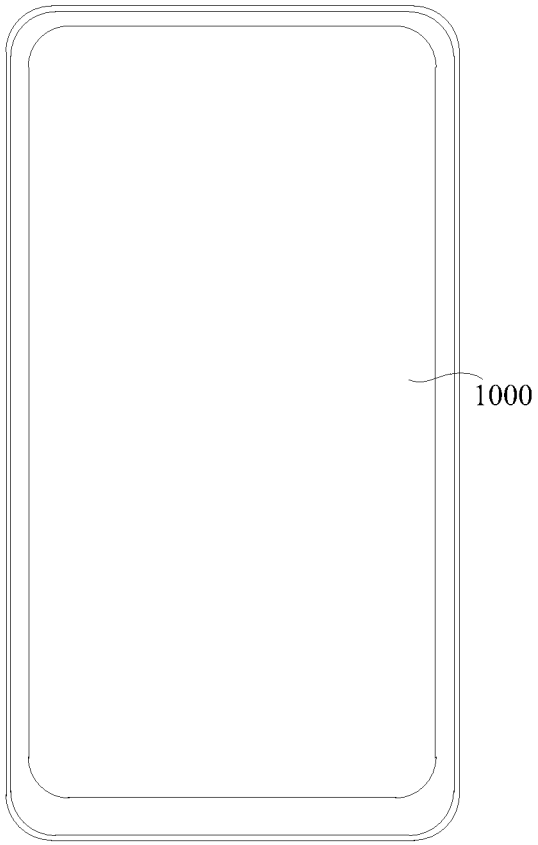
FIG. 17 is a schematic diagram of a display apparatus according to an embodiment of the present disclosure.

An embodiment of the present disclosure also provides a display apparatus. As shown in FIG. 17, FIG. 17 is a schematic diagram of a display apparatus according to an embodiment of the present disclosure. The display apparatus includes the above display panel 1000. The specific structure of the display panel 1000 has been described in detail in foregoing embodiments, and will not be elaborated here. It is appreciated that the display apparatus shown in FIG. 17 is only for schematic illustration. The display apparatus may be any electronic apparatus having a display function, such as a mobile phone, a tablet computer, a laptop computer, an electronic paper book, or a television.

The above are merely some embodiments of the present disclosure, which, as mentioned above, are not intended to limit the present disclosure. Within the principles of the present disclosure, any modification, equivalent substitution, improvement shall fall into the protection scope of the present disclosure.

What is claimed is:

1. A pixel driving circuit, comprising:

a driving transistor having a gate electrode electrically connected to a first node, a first electrode electrically connected to a second node, and a second electrode electrically connected to a third node, the third node being coupled to a light emitting element;

a storage capacitor connected to the first node; and

M first transistors having first electrodes connected to the first node and second electrodes electrically connected to M functional signal terminals, M being an integer greater than or equal to 1;

wherein:

a driving cycle of the pixel driving circuit comprises a light-emitting stage and N non-light-emitting stages, where N is an integer greater than or equal to M;

the M first transistors are respectively turned on in the N non-light-emitting stages and the M first transistors are all turned off in the light-emitting stage;

one of the N non-light-emitting stages comprises a first non-light-emitting stage adjacent to the light-emitting stage; and a channel length L and a width W of each of the M first transistors satisfy:

$$W \times L < \frac{C_{st} \times \Delta V}{\sum_{i=1}^{i=M} \frac{C_{ox} \times (V_{G_off} - V_{N1})^2}{|V_{G_off} - V_{N1}| + |V_{G_off} - V_{X_i}|}};$$

where $C_{st}$ is a capacitance value of the storage capacitor; $\Delta V$ is a critical variation of a potential of the first node when a preset condition is met; $V_{G_off}$ is a potential applied to the gate electrode of the first transistor when the first transistor is turned off; $V_{N1}$ is an initial potential of the first node when the light emitting element emits light; $C_{ox}$ is a capacitance per unit area of a gate capacitor comprising the gate electrode of the first transistor, a gate insulating layer and a channel; $V_{X_1}$ is a potential of an $i^{th}$ functional signal terminal X_i in the first non-light-emitting stage.

2. The pixel driving circuit according to claim 1, wherein the preset condition comprises:

a brightness fluctuation A of the light emitting element satisfies: $3\% \leq A \leq 7\%$.

3. The pixel driving circuit according to claim 1, wherein the storage capacitor comprises a first electrode plate, a second electrode plate, and a first dielectric layer, the first electrode plate and the second electrode plate are arranged opposite to each other, and the first dielectric layer is located between the first electrode plate and the second electrode plate;

the channel length L and the width W of each of the M first transistors further satisfy:

$$W \times L < \frac{\varepsilon_1 \times S \times d_2 \times \Delta V}{\sum_{i=1}^{i=M} \frac{\varepsilon_2 \times d_1 \times (V_{G_off} - V_{N1})^2}{|V_{G_off} - V_{N1}| + |V_{G_off} - V_{X_i}|}};$$

where $\varepsilon_1$ is a relative dielectric constant of the first dielectric layer; S is an area of the first electrode plate directly facing the second electrode plate: $d_1$ is a thickness of the first dielectric layer; $\varepsilon_2$ is a relative dielectric constant of the gate insulating layer of the gate capacitor; and $d_2$ is a thickness of the gate insulating layer of the gate capacitor.

4. The pixel driving circuit according to claim 1, wherein the first transistor comprises a first node reset transistor, the first node reset transistor having a gate electrode electrically connected to a first scan signal terminal, a first electrode electrically connected to the first node, and a second electrode coupled to a first reset signal terminal.

5. The pixel driving circuit according to claim 1, wherein the first transistor comprises a threshold compensation transistor, the threshold compensation transistor having a gate electrode electrically connected to a second scan signal terminal, a first electrode electrically connected to the first node, and a second electrode coupled to the third node.

6. The pixel driving circuit according to claim 1, further comprising a second transistor having a first electrode electrically connected to the second electrode of the first transistor; and the second transistor has a channel length greater than the first transistor.

7. The pixel driving circuit according to claim 6, wherein the gate electrode of the first transistor is electrically connected to a gate electrode of the second transistor.

8. The pixel driving circuit according to claim 1, further comprising a data writing module for connecting a data signal terminal to the second node:

wherein $V_{N1}=V_{data}-|V_{th}|$, where $V_{data}$ is a data voltage provided by the data signal terminal, and $V_{th}$ is a threshold voltage of the driving transistor.

9. The pixel driving circuit according to claim 8, wherein the data writing module comprises a data writing transistor having a gate electrode electrically connected to a third scan signal terminal, a first electrode coupled to the data signal terminal, and a second electrode electrically connected to the second node.

10. The pixel driving circuit according to claim 1, further comprising a light emitting element reset module for connecting a second reset signal terminal to the light emitting element.

11. The pixel driving circuit according to claim 10, wherein the light emitting element reset module comprises a light emitting element reset transistor having a gate electrode electrically connected to a fourth scan signal terminal, a first electrode coupled to the second reset signal terminal, and a second electrode electrically connected to the light emitting element.

12. The pixel driving circuit according to claim 1, further comprising a light emitting control module, wherein the light emitting control module comprises a first control transistor and a second control transistor; and the first control transistor has a gate electrode electrically connected to a light emitting control signal terminal, a first electrode coupled to a power supply voltage signal terminal, and a second electrode electrically connected to the second node, and the second control transistor has a gate electrode electrically connected to the light emitting control signal terminal, a first electrode coupled to the third node, and a second electrode electrically connected to the light emitting element.

13. The pixel driving circuit according to claim 1, wherein the first transistor comprises a P-type transistor, and the channel length L and the width W of the first transistor further satisfy:

$$W \times L < \frac{C_{st} \times \Delta V}{\sum_{i=1}^{i=M} \frac{C_{ox} \times (V_{G_off} - V_{N1})^2}{(V_{G_off} - V_{N1}) + |V_{G_off} - V_{X_i}|}}.$$

14. The pixel driving circuit according to claim 1, wherein the first transistor comprises an N-type transistor, and the channel length L and the width W of the first transistor further satisfy:

$$W \times L < \frac{C_{st} \times \Delta V}{\sum_{i=1}^{i=M} \frac{C_{ox} \times (V_{G_off} - V_{N1})^2}{(V_{N1} - V_{G_off}) + |V_{G_off} - V_{X_i}|}}.$$

15. A display panel, comprising at least one pixel driving circuit, wherein the at least one pixel driving circuit comprises:

a driving transistor having a gate electrode electrically connected to a first node, a first electrode electrically connected to a second node, and a second electrode electrically connected to a third node, the third node being coupled to a light emitting element;

a storage capacitor connected to the first node; and

M first transistors having first electrodes connected to the first node and second electrodes electrically connected to M functional signal terminals, M being an integer greater than or equal to 1;

wherein:

a driving cycle of the pixel driving circuit comprises a light-emitting stage and N non-light-emitting stages, where N is an integer greater than or equal to M;

the M first transistors are respectively turned on in the N non-light-emitting stages and the M first transistors are all turned off in the light-emitting stage;

one of the N non-light-emitting stages comprises a first non-light-emitting stage adjacent to the light-emitting stage; and a channel length L and a width W of each of the M first transistors satisfy:

$$W \times L < \frac{C_{st} \times \Delta V}{\sum_{i=1}^{i=M} \frac{C_{ox} \times (V_{G_off} - V_{N1})^2}{|V_{G_off} - V_{N1}| + |V_{G_off} - V_{X_i}|}};$$

where $C_{st}$ is a capacitance value of the storage capacitor; $\Delta V$ is a critical variation of a potential of the first node when a preset condition is met; $V_{G_off}$ is a potential applied to the gate electrode of the first transistor when the first transistor is turned off: $V_{N1}$ is an initial potential of the first node when the light emitting element emits light; $C_{0x}$is a capacitance per unit area of a gate capacitor comprising the gate electrode of the first transistor, a gate insulating layer and a channel; $V_{X_1}$ is a potential of an $i^{th}$ functional signal terminal X_i in the first non-light-emitting stage.

16. The display panel according to claim 15, wherein the at least one pixel driving circuit comprises a plurality of pixel driving circuits, each of the plurality of pixel driving circuits further comprises a light emitting element reset module and a third transistor, and the light emitting element reset module is configured to connect a second reset signal terminal to the light emitting element; the third transistor has a first electrode electrically connected to the second electrode of the first transistor, and a second electrode coupled to the second reset signal terminal; and the third transistor of one of the plurality of pixel driving circuits is reused as the light emitting element reset module of another one of the plurality of pixel driving circuits.

17. A display apparatus, comprising a display panel comprising at least one pixel driving circuit, wherein the at least one pixel driving circuit comprises:

a driving transistor having a gate electrode electrically connected to a first node, a first electrode electrically connected to a second node, and a second electrode electrically connected to a third node, the third node being coupled to a light emitting element;

a storage capacitor connected to the first node; and

M first transistors having first electrodes connected to the first node and second electrodes electrically connected to M functional signal terminals, M being an integer greater than or equal to 1;

wherein:

a driving cycle of the pixel driving circuit comprises a light-emitting stage and N non-light-emitting stages, where N is an integer greater than or equal to M;

the M first transistors are respectively turned on in the N non-light-emitting stages and the M first transistors are all turned off in the light-emitting stage;

one of the N non-light-emitting stages comprises a first non-light-emitting stage adjacent to the light-emitting stage; and a channel length L and a width W of each of the M first transistors satisfy:

$$W \times L < \frac{C_{st} \times \Delta V}{\sum_{i=1}^{i=M} \frac{C_{ox} \times (V_{G_off} - V_{N1})^2}{|V_{G_off} - V_{N1}| + |V_{G_off} - V_{X_i}|}};$$

where $C_{st}$ is a capacitance value of the storage capacitor; $\Delta V$ is a critical variation of a potential of the first node when a preset condition is met; $V_{G_off}$ is a potential applied to the gate electrode of the first transistor when the first transistor is turned off; $V_{N1}$ is an initial potential of the first node when the light emitting element emits light; $C_{ox}$ is a capacitance per unit area of a gate capacitor comprising the gate electrode of the first transistor, a gate insulating layer and a channel; $V_{X_1}$ is a potential of an $i^{th}$ functional signal terminal X_i in the first non-light-emitting stage.

* * * * *